US008591322B2

(12) United States Patent
Cohen et al.

(10) Patent No.: US 8,591,322 B2
(45) Date of Patent: Nov. 26, 2013

(54) RECONCILING PAYBACK PERCENTAGE OF A GAMING DEVICE WITH TRANSFERABLE RETURN

(71) Applicant: IGT, Reno, NV (US)

(72) Inventors: Alexander C. Cohen, Reno, NV (US); Bryan D. Wolf, Reno, NV (US); Paulina Rodgers, Reno, NV (US); James A. Vasquez, Carson City, NV (US); Garrett Olson, Reno, NV (US); Ty Cornell Jones, Reno, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 13/674,297

(22) Filed: Nov. 12, 2012

(65) Prior Publication Data

US 2013/0095911 A1 Apr. 18, 2013

Related U.S. Application Data

(62) Division of application No. 12/617,614, filed on Nov. 12, 2009, now Pat. No. 8,328,629.

(51) Int. Cl.
*A63F 9/24* (2006.01)

(52) U.S. Cl.
USPC ..... 463/25

(58) Field of Classification Search
USPC ..... 463/25
See application file for complete search history.

(56) References Cited

U.S. PATENT DOCUMENTS

| | | | | |
|---|---|---|---|---|
| 6,607,441 | B1 | 8/2003 | Acres | |
| 2005/0181860 | A1 * | 8/2005 | Nguyen et al. | 463/20 |
| 2006/0160620 | A1 | 7/2006 | Matthews et al. | |
| 2007/0259713 | A1 | 11/2007 | Fiden et al. | |
| 2009/0124335 | A1 * | 5/2009 | Watkins et al. | 463/20 |
| 2010/0210346 | A1 * | 8/2010 | Berman et al. | 463/20 |
| 2011/0111818 | A1 * | 5/2011 | Baerlocher | 463/11 |
| 2011/0117989 | A1 * | 5/2011 | Kennedy et al. | 463/20 |

OTHER PUBLICATIONS

U.S. Office Action dated Apr. 26, 2012 issued in U.S. Appl. No. 12/617,614.
U.S. Notice of Allowance dated Sep. 19, 2012 issued in U.S. Appl. No. 12/617,614.

* cited by examiner

*Primary Examiner* — Pierre E Elisca
(74) *Attorney, Agent, or Firm* — Neal, Gerber & Eisenberg LLP

(57) ABSTRACT

An electronic gaming system includes a server and a plurality of electronic gaming machines, each machine including a logic system configured for communication with the server, a memory and a theoretical coin-out meter. The memory includes instructions executable by the logic system for running on the gaming machine a persistence game having one or more recordable persistence states leading to a redeemable persistence award. Each persistence state has a persistence value representing a portion of the persistence award. The persistence game is interruptible at a first machine and resumable at a second machine at a recorded persistence state. The theoretical coin-out meter stores unawarded persistence values accumulated by the machine from advancing the persistence game during game play among the one or more persistence states. A persistence award redeemed at one of the machines is reconciled with unawarded persistence values accumulated at another one or more of the machines.

25 Claims, 10 Drawing Sheets

RECONCILING PAYBACK PERCENTAGE OF A GAMING DEVICE WITH TRANSFERABLE RETURN

CROSS-REFERENCE TO RELATED APPLICATIONS

This application is a divisional of and claims priority to co-pending U.S. patent application Ser. No. 12/617,614, entitled "RECONCILING PAYBACK PERCENTAGE OF A GAMING DEVICE WITH TRANSFERABLE RETURN" and filed Nov. 12, 2009, which is hereby incorporated by reference in its entirety and for all purposes.

FIELD OF THE INVENTION

The present invention relates generally to electronic wager gaming machines and similar devices.

BACKGROUND OF THE INVENTION

Electronic Gaming Machines (EGMs) have become a mainstay in modern casinos. EGMs provide an automated way for casinos to provide their customers with a wide variety of entertainment and wagering opportunities. Generally, EGMs in service today simulate traditional card games, such as draw poker, or simulate the action of an electro-mechanical slot machine. Advances in computer technologies now allow game designers to expand the slot machine concept beyond that of the traditional upright spinning reel that pays out when certain visual symbols (e.g. BAR, 7, cherries) align in a winning combination on a single payline. Some of the more advanced EGMs include LCD monitors that display colorful animation, multiple paylines, interactive bonus games, and other computer-generated audio/video effects that are limited only by a programmer's imagination. Computerized advancements have also enabled casinos to link together banks of EGMs into a network to facilitate game management and accounting functions. Although current EGMs are generally satisfactory, it would be desirable to provide improved EGMs and related systems.

SUMMARY OF THE INVENTION

The present invention discloses an electronic gaming machine (EGM) that in a first embodiment includes a logic system comprising at least one processor, and a computer readable memory configured for communication with the logic system, the memory including instructions executable by the logic system for running on the gaming machine a persistence game having one or more persistence states leading to a redeemable persistence award, where each persistence state having a persistence value representing a portion of the persistence award. The EGM further includes a verification interface configured for communication with the logic system, the verification interface configured to receive information for determining whether to initiate play of the persistence game at a previously achieved persistence state, a coin-in meter operated by the logic system for storing in the memory a value for accumulated wagers made on the electronic gaming machine, a coin-out meter operated by the logic system for storing in the memory a value for accumulated coin-out disbursed by the machine, and a theoretical coin-out meter operated by the logic system for storing in the memory unawarded persistence values accumulated by the machine from advancing the persistence game during game play among the one or more persistence states, the theoretical coin-out meter calculating a value for theoretical coin-out as a sum of (i) the accumulated coin-out value and (ii) a difference between the persistence value of a current persistence state and the persistence value of a previous persistence state. The EGM may further include a return-to-player (RTP) calculator operated by the logic system executing a program in the memory, the calculator determining an RTP value as a ratio of the accumulated theoretical coin-out value to the accumulated coin-in value, wherein the determined RTP value converges to a theoretical RTP value of the EGM over time, wherein the theoretical RTP value is based only on actual coin-in and actual coin-out. The EGM may further include a network interface configured for communication with a plurality of other EGMs, wherein the logic system is further configured to reconcile actual coin-out and theoretical coin out for the EGM and the plurality of other EGMs.

In another embodiment, the invention provides an electronic gaming system having a server and a plurality of EGMs, where each EGM includes a logic system configured for communication with the server. Each EGM may further include (i) a computer readable memory configured for communication with the logic system, the memory including instructions executable by the logic system for running on the EGM a persistence game having one or more recordable persistence states leading to a redeemable persistence award, each persistence state having a persistence value representing a portion of the persistence award, the persistence game interruptible at any one of the EGMs and resumable at any other of the EGMs at a recorded persistence state, (ii) a verification interface configured for communication with the logic system and further configured for receiving information regarding an advanced state of the one or more persistence states achieved during prior play of the persistence game to permit the system to start the persistence game at the advanced state, and (iii) a theoretical coin-out meter configured for communication with the logic system for storing in the memory unawarded persistence values accumulated by the EGM from advancing the persistence game during game play among the one or more persistence states. The invention may further include a clearinghouse program stored on a machine-readable medium and executable by the server for reconciling a persistence award redeemed at one of the EGMs with unawarded persistence values accumulated at another one or more of the EGMs that recorded persistence states in the persistence game corresponding to the persistence award redeemed. Each EGM in the system may further include a coin-out meter operated by the logic system for storing in the memory a value for accumulated coin-out disbursed by the EGM, wherein the theoretical coin-out meter calculates a value for theoretical coin-out as a sum of (i) the accumulated coin-out value and (ii) a difference between the persistence value of a current persistence state and the persistence value of a previous persistence state. Each EGM may further include a coin-in meter operated by the logic system for storing in the memory a value for accumulated coin-in received by the machine and a return-to-player (RTP) calculator operated by the logic system executing a program in the memory, the calculator determining an RTP value as a ratio of the theoretical coin-out value to the accumulated coin-in value, wherein for each EGM, the determined RTP value converges to a theoretical RTP value of the EGM over time, wherein the theoretical RTP value is based only on actual coin-in and actual coin-out.

In another embodiment the invention provides a method for operating a personal persistence game to enable reconciliation of persistence values achieved on an EGM with persistence awards redeemed on another EGM. The method may be practiced for EGMs each having a logic system communicating with memory and configured to run a persistence game having one or more recordable persistence states transferable to another EGM, where the persistence states lead to a redeemable persistence award when persistence criteria are satisfied. The method includes steps for storing in the memory of the EGM a persistence value for each of the persistence states, determining a persistence state at which to initiate play of the persistence game, running the persistence game at the determined persistence state, recording each persistence state achieved during play of the persistence game, calculating a value for theoretical coin-out as a function of the persistence value for each persistence state achieved, and storing in the memory the value for theoretical coin-out. The method may further include steps for storing in the memory a value for accumulated coin-out disbursed by the EGM and for calculating the value for theoretical coin-out as a sum of (i) the accumulated coin-out value and (ii) a difference between the persistence value of a current persistence state and the persistence value of a previous persistence state. The method may further include steps for storing in the memory a value for accumulated coin-in received by the electronic gaming machine and for calculating a return-to-player (RTP) value as a ratio of the theoretical coin-out value to the accumulated coin-in value, wherein the calculated RTP value converges to a theoretical RTP value of the EGM over time, wherein the theoretical RTP value is based only on actual coin-in and actual coin-out.

In another embodiment, the invention provides for a network of EGMs, a method for reconciling payback percentage attributable to one or more of the EGMs with a persistence award redeemed on another of the EGMs. The method may be practiced in a network wherein each EGM includes a logic system configured for communication with a server, and a computer readable memory configured for communication with the logic system, the memory including instructions executable by the logic system for running on the EGM a persistence game having one or more recordable persistence states, where the persistence states lead to a redeemable persistence award. The method includes steps for storing in the memory a persistence value for each of the persistence states, each persistence value representing a portion of the persistence award, initiating play of the persistence game at any one of the gaming machines at a recorded persistence state, calculating for each gaming machine played a value for theoretical coin-out as a function of the persistence value for each persistence state achieved after initiating play of the persistence game, storing in the memory of the gaming machine played the value for theoretical coin-out, recording each persistence state achieved after initiating play of the persistence game, and reimbursing a machine redeeming the persistence award by an amount equal to the sum of theoretical coin-out values calculated for non-redeeming machines that recorded persistence states during play of the persistence game. The method may further include steps for storing in the memory of at least one of the EGMs a value for accumulated coin-out disbursed by the at least one EGM and for calculating the value for theoretical coin-out for the at least EGM as a sum of (i) the accumulated coin-out value and (ii) a difference between the persistence value of a current persistence state and the persistence value of a previous persistence state. The method may further includes steps for storing in the memory of the at least one EGM a value for accumulated coin-in received by the at least one EGM and for calculating a return-to-player (RTP) value as a ratio of the theoretical coin-out value to the accumulated coin-in value, wherein the calculated RTP value converges to a theoretical RTP value of the at least one EGM over time, wherein the theoretical RTP value is based only on actual coin-in and actual coin-out. In variations of the invention, the reimbursing step may be performed by a clearinghouse having no ownership interest in the EGMs, and the EGMs may be located within a single casino, within more than one casino, within a single jurisdiction, or across more than one jurisdiction.

In another embodiment, the invention provides a clearinghouse server for reconciling actual coin-out and theoretical coin-out among a group of EGMs each configured to accumulate unawarded persistence values and redeem persistence awards from persistence game operations. The clearinghouse server includes a logic system configured for communication with the group of EGMs, a memory in communication with the logic system, and a persistence value reconciliation program retrievable from the memory and executable by the logic system, the program when executed performing steps for (i) polling a group of EGMs for actual coin-out values and theoretical coin-out values, each EGM in the group of EGMs configured to run one or more persistence games, (ii) subtracting a sum of the actual coin-out values of the group of EGMs from a sum of the theoretical coin-out values of the group of EGMs to obtain a difference, and (iii) reconciling the group of EGMs according to whether the difference is positive or negative. The reconciling process run by the clearinghouse server may include a step for crediting the group of EGMs an amount equal to the difference if the difference is positive, or a step for charging the group of EGMs an amount equal to the difference if the difference is negative. The group of EGMs may be distributed among more than one casino, among more than one owner, or over more than one jurisdiction.

BRIEF DESCRIPTION OF THE DRAWINGS

Other systems, methods, features and advantages of the invention will be or will become apparent to one with skill in the art upon examination of the following figures and detailed description. It is intended that all such additional systems, methods, features and advantages be included within this description, be within the scope of the invention, and be protected by the accompanying claims. Component parts shown in the drawings are not necessarily to scale, and may be exaggerated to better illustrate the important features of the invention. In the drawings, like reference numerals may designate like parts throughout the different views, wherein:

DETAILED DESCRIPTION OF THE INVENTION

Figure 1:
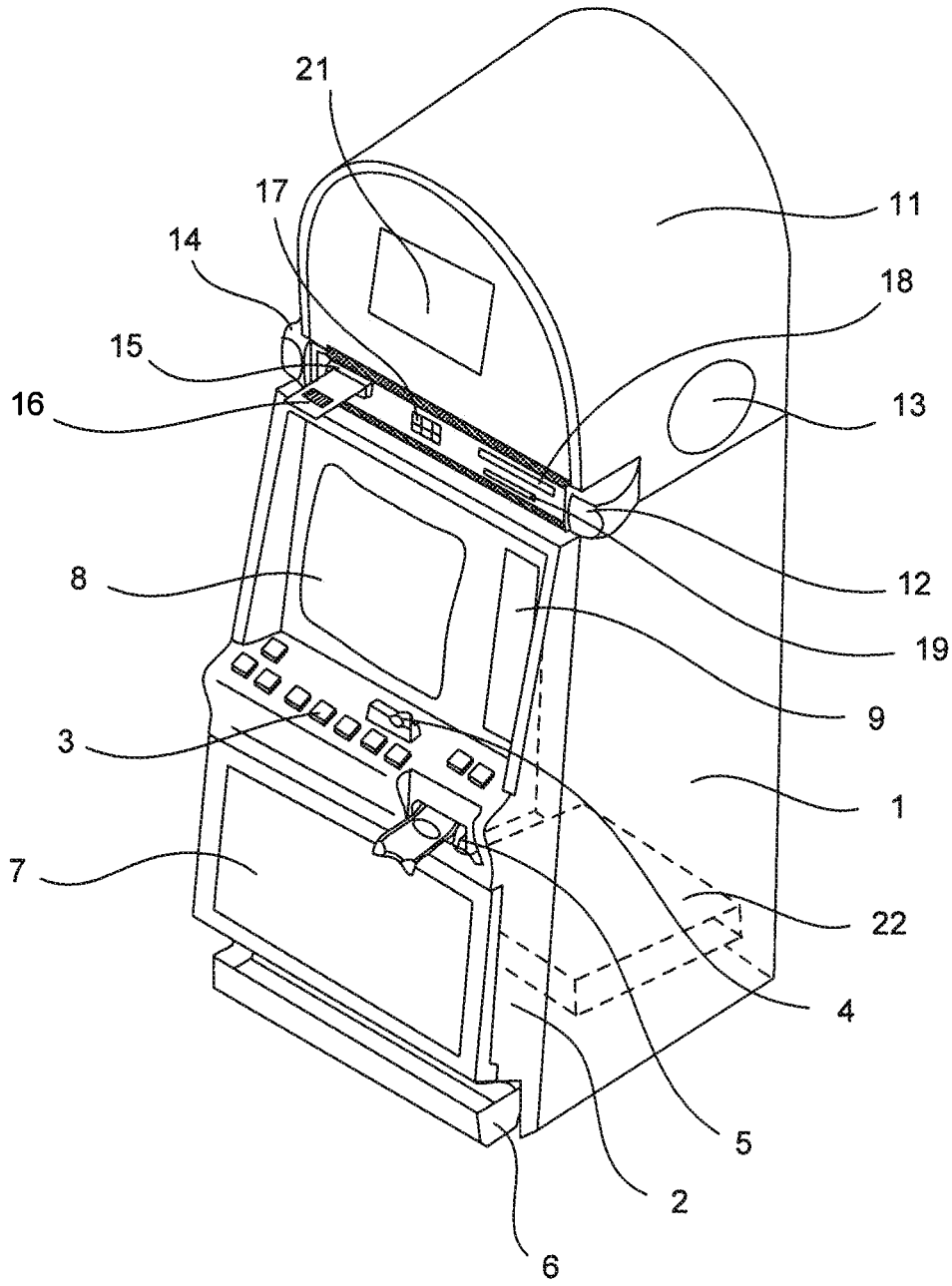
FIG. 1 is a perspective external view illustrating a typical EGM configured according to one embodiment of the invention.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. For example, the steps of methods shown and described herein are not necessarily performed in the order indicated. It should also be understood that the methods of the invention may include more or fewer steps than are indicated. Device functionality may be apportioned by grouping or dividing tasks in any convenient fashion. Therefore, when steps are described herein as being performed by a single device, the steps may alternatively be performed by multiple devices and vice versa.

Various embodiments of the present invention involve persistence games. A persistence game offers an award for achieving multiple pre-designated outcomes. Each pre-designated outcome alters the state of the persistence game, with at least one state awarding a persistence award. Usually, multiple plays of a game are necessary to trigger the persistence award. In the past, the persistence feature was typically associated with a single EGM. When a player ends a session of play, the state of the persistence game (the "persistence state") and any value associated with the persistence state may be eventually lost if the player does not continue the persistence game within a specified time period. In some cases if a player abandons a persistence game or walks away from an EGM after advancing the persistence state, another player may continue the game and benefit, perhaps undeservedly, from the persistence state left on the EGM.

A personal persistence game may be associated with a single player. In a personal persistence game, when a player ends a session of play, his persistence game state may be recorded, e.g., in an account associated with the player, on a machine-readable medium such as a ticket, a card or another such portable instrument. When the player returns, the persistence game state may be restored (e.g., by reference to the player's account or to a portable instrument) and the personal persistence game resumes.

The absence of personal persistence features from EGMs is due primarily to difficulties that would arise if a casino attempted to reconcile the Return-To-Player (RTP) of an individual EGM that provides persistence games, when game play on one EGM can be translated to payouts on another EGM. Also often called Payback Percentage, RTP is calculated as the ratio of total money won (Coin Out) to total money wagered (Coin In). For example, if two machines were positioned adjacent or near one another on a casino floor, and players were to habitually collect value on one machine but redeem it on the other, then the RTP when evaluated or audited on each machine individually would never truly represent the actual RTP of the machine, even though the combined RTP would. This situation would lead to accounting difficulties, since EGMs are generally evaluated or audited one machine at a time, and each EGM's observed RTP is expected to match its theoretical RTP.

In such an evaluation or audit of an EGM, performance information is typically taken from two meters on the EGM: a coin-in meter, which keeps track of the total amount of wagers made on the EGM, and a coin-out meter, which keeps track of the total amount of pays made from game wins on the EGM. In a scenario where the value of a personal persistence feature could be translated across multiple casino floors, the issue would be further exacerbated unless there were a method to reconcile true RTP against theoretical when evaluating a single EGM individually, or a bank of EGMs at a casino. Without that reconciliation, an entire casino could make payouts from game play at another casino, without any mechanism for being reimbursed.

Other difficulties could arise with account value management in a regulated casino environment that offers persistence games. If each account were treated as having an equivalent cash value (with a minimum of 0), casino practices and regulatory constraints would nonetheless affect various relevant factors. These factors include account value expiration, return of expired value to the gaming public (logging expired value as "win" is generally frowned upon by regulators), merging of accounts, and collection of account value after normal redemption mechanisms are invalid.

The following disclosure presents various embodiments of the invention for providing personal persistence games on EGMs and/or other gaming devices. Personal persistence games according to the invention allow a player to save a persistence state achieved during game play in a machine-readable memory and restart the persistence game at the saved state at another time on the same or on a different EGM. Payouts to a player, including persistence awards achieved when persistence criteria are satisfied, may be transferable among many gaming devices. The invention also provides methods for reconciling return-to-player (RTP) values among a group of EGMs running a personal persistence game that advance persistence states in a single game for which a persistence award is eventually won.

Referring now to FIG. 1, an electronic gaming machine (EGM) 10 of the present invention is shown in transparent perspective. EGM 10 may include a main cabinet 1, which generally surrounds the machine interior and is viewable by users (a.k.a. players). The main cabinet 1 may include a main door 2 on the front of the machine, which opens to provide access to the interior of the machine. Additional components may be attached to the main door 2, including player-input switches or buttons 3, a coin acceptor 4, a bill validator 5, a coin tray 6, and a belly glass 7. A video display monitor 8 and an information panel 9 may be viewable through the main door 2. The display monitor 8 may be any conventional electronically controlled video monitor such as a cathode ray tube, or a flat-panel monitor using technology such as plasma, LCD, or LED. The information panel 9 may be a back-lit, silk screened glass panel with lettering to indicate general game information including, for example, a game denomination (e.g. $0.25 or $1). The player-input switches 3, bill validator 5, video display monitor 8, and information panel 9 are all devices used by a player to initiate and/or play a game on EGM 10. These devices may be controlled by circuitry (e.g. a master gaming controller) housed inside the main cabinet 1 of the EGM 10.

Many different types of games, including mechanical slot games, video slot games, video poker, video black jack, video pachinko, and lottery, may be provided by an EGM of the present invention. Typically, games provided by EGM 10 are electronic games of chance found in a casino and subject to jurisdictional regulations governing gambling and casino operations in general. The various games presentable on an EGM 10 may be differentiated according to themes, sounds, graphics, game type (e.g., slot game vs. card game), denomination, number of paylines, maximum jackpot, progressive or non-progressive style, bonus games, etc. EGM 10 may be operable to allow a player to select a game of chance to play from a plurality of instances available on the gaming machine. For example, the gaming machine may provide a menu with a list of the instances of games that are available for play on the gaming machine and a player may be able to select from the list a first instance of a game of chance that they wish to play.

The various instances of games available for play on EGM 10 may be stored as game software on a mass storage device in the gaming machine or may be generated on a remote gaming device but then displayed on the gaming machine. EGM 10 may execute game software, such as but not limited to video streaming software that allows the game to be displayed on the gaming machine. When an instance of a game is stored on EGM 10, it may be loaded from the mass storage device into a RAM for execution. In some cases, after a selection of an instance, the game software that allows the selected instance to be generated may be downloaded from a remote gaming device, such as another gaming machine.

An EGM 10 may also include a top box 11, which sits on top of the main cabinet 1. The top box 11 may house a number of devices, which may be used to add features to a game being played on the EGM, including speakers 12, 13, 14, a ticket printer 15 that prints bar-coded tickets 16, a key pad 17 for entering player tracking information, a florescent display 18 for displaying player tracking information, and a card reader 19 for entering a magnetic striped card containing player tracking information. Card reader 19 is one example of a verification interface. The ticket printer 15 may be used to print tickets for a cashless ticketing system. Further, the top box 11 may house different or additional devices than those shown in FIG. 1. For example, the top box 11 may contain a bonus wheel or a back-lit silk-screened panel that may be used to add bonus features to the game being played on the EGM. As another example, the top box 11 may contain a display 21 for displaying information about a progressive jackpot offered on the EGM. During a game, the various electronic devices within the EGM 10 may be controlled and powered, in part, by circuitry 22 housed within the main cabinet 1. Circuitry 22 may include, for example, a logic system having one or more processors such as a master game controller, memory configured for communication with the logic system and for storing game software, and coin-in and coin-out metering circuits, as well as power supplies and other supporting digital and analog electronics.

It should be understood that EGM 10 is but one example from a wide range of gaming machine designs on which the present invention may be implemented. For example, not all suitable gaming machines have top boxes or player tracking features. Further, some gaming machines have only a single game display mechanical or video, while others are designed for bar tables and have displays that face upward. As another example, a game may be generated in on a host computer and may be displayed on a remote terminal or a remote gaming device. The remote gaming device may be connected to the host computer via a wired or wireless network of some type such as a local area network, a wide area network, an intranet or the Internet. The remote gaming device may be a portable gaming device such as but not limited to a cell phone, a personal digital assistant, and a wireless game player. Images rendered from 3-D gaming environments may be displayed on portable gaming devices that are used to play a game of chance. Further, a gaming machine or server may include gaming logic for commanding a remote gaming device to render an image from a virtual camera in a 3-D gaming environments stored on the remote gaming device and to display the rendered image on a display located on the remote gaming device. Thus, various aspects of the present invention, as described herein, can be deployed on modified versions of many gaming machines now available, on other types of devices (e.g., as described below with reference to FIG. 9) or on other devices that may be hereafter developed.

Figure 2:
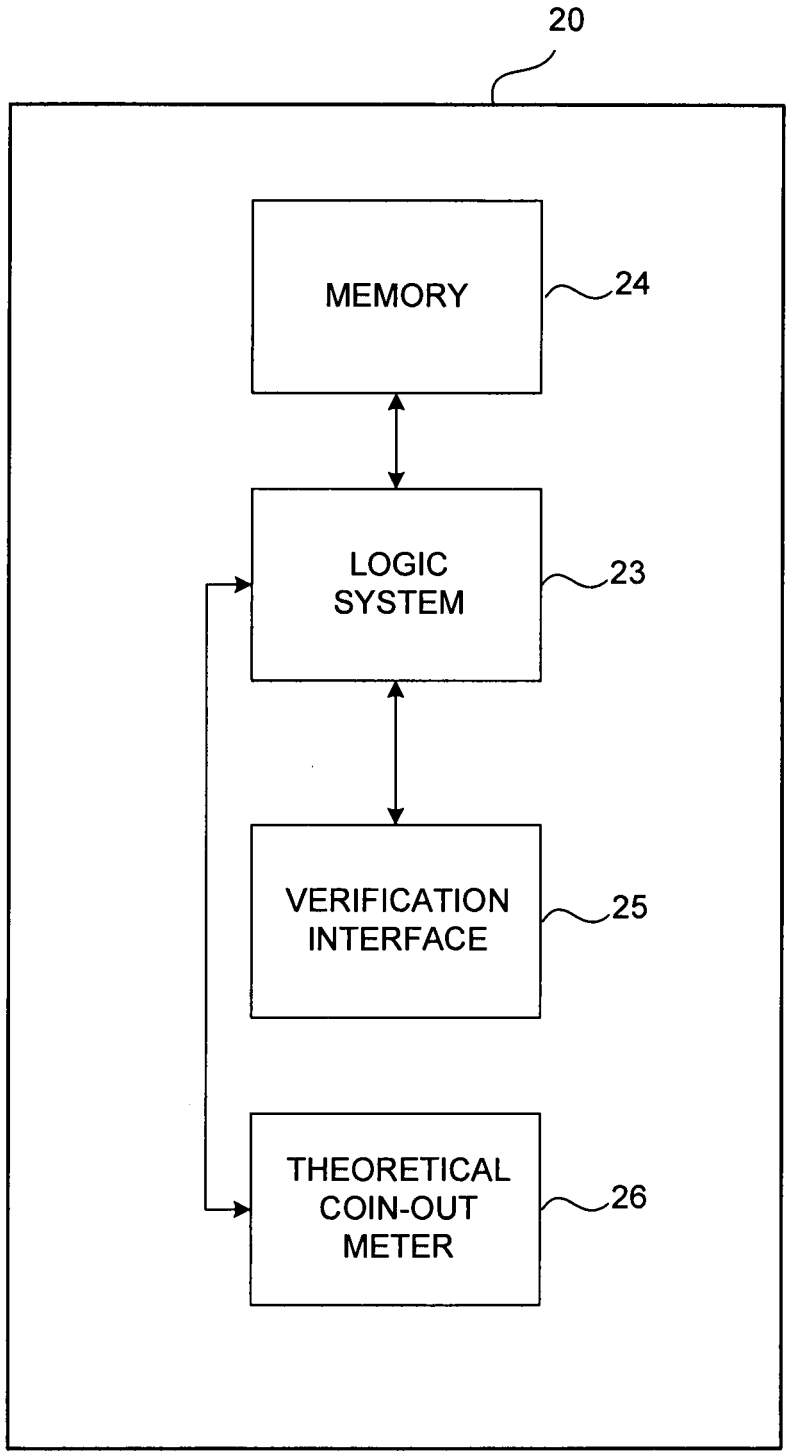
FIG. 2 is a block diagram of an EGM configured to run a personal persistence game according to one embodiment of the invention.

FIG. 2 is a block diagram that shows an embodiment of an EGM 20 configured to run a personal persistence game according to the invention. EGM 20 may include a logic system 23 configured for communication with other components or modules within the EGM 20 such as a memory 24, a verification interface 25, and a theoretical coin-out meter 26. Logic system 23 may include one or more processors, microprocessors, or application specific integrated circuits (ASICs) such as those used in personal computer systems, portable communication systems, and video game systems. Logic system 23 may communicate with the other components and modules using wired or wireless means, indicated generally in the figure by the double-arrowed data communication lines. Logic system 23 may execute a program for running a persistence game according to the invention on the EGM 20.

The memory 24 may be configured for communication with the logic system 23. Memory 24 may be any suitable computer readable memory known in the art for storing data or programs, including electronic, magnetic and optical type memories, or any combination of these. For example, memory 24 may include some combination of volatile and non-volatile memory. The volatile memory may be a random access (RAM) device or bank of RAM devices, including one or more of SRAM, DRAM, Z-RAM, TTRAM or A-RAM. The non-volatile memory may be one or more of a read-only memory (ROM), a flash memory, a magnetic memory (e.g. a hard disk), an optical disk, RAM, CBRAM, PRAM, SONOS, RRAM, racetrack memory, NRAM, millipede or other memory technology known in the art for storing computer readable information.

Memory 24 may store persistence game software as a series of instructions executable by the logic system 23 for running a persistence game on EGM 20. In one embodiment, the persistence game stored in memory 24 is a type of persistence game having one or more persistence states in a sequence of persistence states. As each persistence state is achieved through game play, the state of the persistence game may advance to the next persistence state in the sequence. Collectively, the achievement of all persistence states satisfies the persistence criteria for the persistence game, resulting in the disbursement or awarding of a redeemable persistence award. Memory 24 may also store a persistence value that is associated with each persistence state, such that each persistence value represents a portion of the persistence award. In one embodiment, a sum of the persistence values of the persistence states equals an average expected value of the persistence award.

Verification interface 25 may comprise a device configured for communication with the logic system 23 and/or a program executable by the logic system 23, for determining whether to initiate play of a persistence game on EGM 20 at a previously achieved persistence state. In one embodiment, verification interface 25 may operate as, or cooperate with, key pad 17 or card reader 19 to receive information from a player account. The information received may indicate whether a player has previously advanced a persistence game to an unawarded persistence state. For example, verification interface 25 may receive data through key pad 17 that identifies a player who is associated with a particular player account. Information associated with the player account may be stored in memory 24 or in some other memory location accessible by logic system 23, e.g. through a network link. The verification interface 25 may then check the player account for data indicating the most advanced state achieved by the player in the persistence game that the player has decided to resume. If the player account indicates that the player is entitled to resume a persistence game at an advanced game state, the logic system may initiate play of the persistence game at the advanced state. Otherwise, the logic system may start the game at its beginning.

Alternatively, verification interface 25 may obtain persistence state data from a machine-readable medium, such as a ticket, a player identification card, a bonus award card, or some other type of player portable instrument having persistence state data pertaining to a one or more previously played games stored thereon. Such embodiments may allow a player to access stored persistence state data while remaining anonymous. For example, a card or ticket reader of an EGM may read persistence state data from a player portable instrument that does not include player identification data.

Theoretical coin-out meter 26 may comprise a device configured for communication with the logic system 23 and/or or a program stored in memory 24 executable by the logic system 23. Theoretical coin-out meter 26 may be configured for determining the sum of all payouts made on the EGM plus a representation of the net persistence value added by persistence states achieved on the EGM. The net persistence value of the EGM is a theoretical monetary value representing the payout percentage for a persistence award yet to be awarded for which the EGM is potentially liable. The liability for the payout percentage may accumulate for the EGM each time a player achieves a persistence state by advancing the state of a persistence game being played. The value returned by an EGM's theoretical coin-out meter may be compared to the EGM's coin-in meter to reconcile the return-to-player (RTP) for the particular EGM, regardless of whether the EGM disbursed a persistence award. According to some aspects of the invention, theoretical coin-out meter 26 is configured so that the ratio of theoretical coin-out to actual coin-in will converge, over a long period of time, to the theoretical RTP value of the EGM. This may be achieved by proper selection of persistence values that are associated with each unawarded persistence state.

In one embodiment, an EGM 20 may include an RTP calculator operable by the logic system 23 executing an RTP program stored in memory 24. The RTP calculator may determine an RTP value as a ratio of the accumulated theoretical coin-out value to the accumulated coin-in value.

In one embodiment, theoretical coin-out meter 26 determines the value for theoretical coin-out (CO-th) incurred by EGM 20 by performing a calculation that sets CO-th equal to a sum of actual coin-out dispensed from the EGM and unawarded persistence values accumulated in the EGM. An unawarded persistence value may accumulate in the EGM for each persistence state achieved during play on the EGM. The unawarded persistence value may be equal to the persistence value stored in memory 24 that is associated with the persistence state achieved. In one embodiment, the theoretical coin-out meter 26 calculates a value for CO-th that is the sum of (i) accumulated actual coin-out and (ii) a difference between the persistence value of a current persistence state and the persistence value of a previous persistence state.

Figure 3:
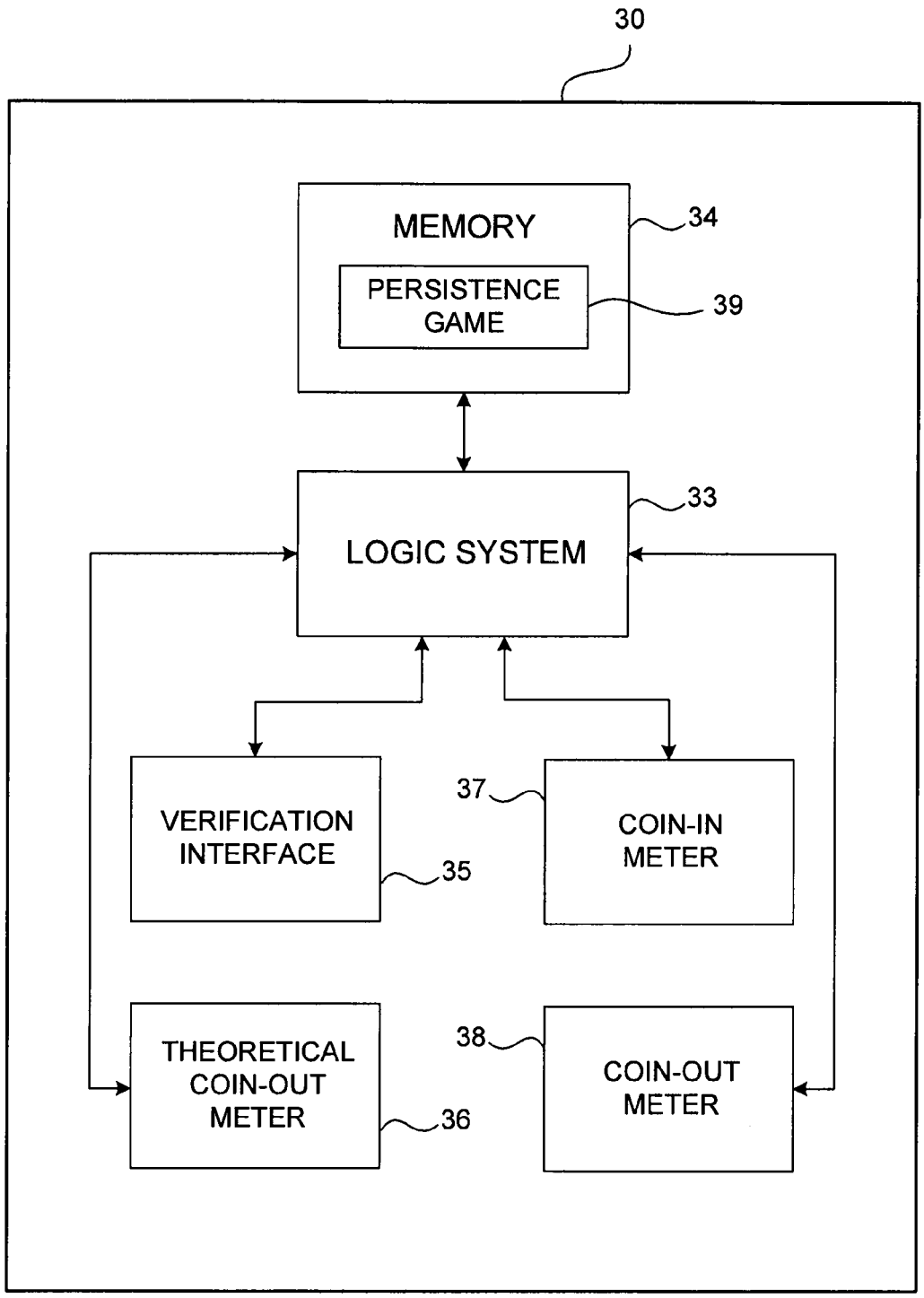
FIG. 3 is a block diagram of an EGM configured to run a personal persistence game according to another embodiment of the invention.

FIG. 3 depicts in block diagram form an embodiment of an EGM 30 configured to run a personal persistence game according to the invention. EGM 30 includes a logic system 33, memory 34, verification interface 35, and theoretical coin-out meter 36 that may be configured similarly to corresponding components of EGM 20 shown in FIG. 2 and described above. In addition, EGM 30 may include a coin-in meter 37, a coin-out meter 38, and a persistence game program 39 stored in the memory 34.

Coin-in meter 37 and coin-out meter 38 may comprise devices configured for communication with the logic system 23 and/or programs stored in memory 24 executable by the logic system 23. Coin-in meter 37 determines a total amount of money or credit wagered by players on EGM 30. In one embodiment, coin-in meter 37 maintains a running total of all money committed by players to wagers made during play of a persistence game according to the invention. Coin-out meter 38 determines a total amount of money disbursed or credit awarded to players on EGM 30. In one embodiment, coin-out meter 38 maintains a running total of all money disbursed to players during play of a persistence game according to the invention. Coin-in meter 37 and coin-out meter 38 may be conventional cash-value tracking meters associated with electronic gaming machines.

Persistence game program 39 includes instructions in the form of software executable by the logic system 33 for running a persistence game on EGM 30. The persistence game 39 may comprise a wager-based game, such as a simulated game of poker played with a virtual 52-card deck of playing cards that corresponds to a traditional deck of playing cards. In response to a player making a wager of some portion of credit available on EGM 30 and initiating game play (e.g. by activating one or more player input switches), logic system 33 runs the persistence game and generates a game play outcome for the player. The game play outcome may be displayed on a video output screen of the EGM 30.

The persistence game may include a primary game that provides the basis for fulfilling criteria that advances the game among multiple persistence states. The multiple persistence states may lead to a persistence award when all persistence criteria are satisfied. For example, in a persistence game based on poker, the primary game may be five-card draw which pays out various awards to a player achieving certain configurations of cards in a single game outcome (e.g. two-of-a-kind, flush, full house, etc.). To advance among persistence states, the persistence game may require that during play of the primary game, a player achieve specific combinations of outcomes to fulfill predetermined persistence criteria. For example, in the poker game, a persistence criterion may be fulfilled when a single player achieves five occurrences of four-of-a-kind. In this example, the first persistence state is achieved when the outcome is the first occurrence of four-of-a-kind, the second persistence state is achieved when the outcome is the second occurrence of four-of-a-kind, and so on, where each occurrence of four-of-a-kind advances the persistence state to the next state in the sequence. With each advancement of the persistence state, the theoretical coin-out meter 36 calculates a new value, CO-th, for theoretical coin-out for EGM 30, and stores the value.

In another embodiment, the persistence game may provide and keep track of multiple game state elements. For example, while tracking outcomes of the same player achieving a first element (e.g. outcomes of four-of-a-kind), the persistence game may also track outcomes of the same player achieving a second element (e.g. a flush). Persistence criteria may be fulfilled for achieving predetermined numbers of the first element and/or the second element, e.g., five four-of-a-kinds, twenty flushes or both. In another embodiment, the persistence game may establish a sequence of persistence state elements that lead to a persistence award wherein each element represents a different outcome. For example, a first persistence state may be achieved when an outcome for the player is three-of-a-kind, a second persistence state may be achieved when another outcome for the same player is a full house, and a third persistence state may be achieved when another outcome for the same player is a straight flush. There are many different possible outcomes or combinations of outcomes that may determine a persistence state in a particular persistence game.

According to one aspect of the invention, a single player may achieve one or more persistence states while playing a persistence game 39 on a particular EGM and store, or cause to be stored, the persistence state or states to a player account or to a player portable instrument when the player decides to stop playing the game. The player may later return to the same EGM or to a second EGM that offers the same persistence game 39 and cause the first or second EGM to retrieve the stored persistence state or states. When this is done, the persistence game 39 may be run by the logic system 33 and resume the persistence game at the persistence state corresponding to the latest state achieved by that player. For example, if the player had previously stored a persistence state representing a first outcome of a royal flush, the persistence game 39 could be resumed such that the next outcome of a royal flush would advance the game to a persistence state representing a second royal flush. Eventually, if all persistence criteria are satisfied, the EGM on which the player achieves the final persistence state in the persistence state sequence may disburse to the player the persistence award, regardless of whether the player had achieved other persistence states that led to the persistence award on another EGM.

Table 1 below further illustrates one example operation of a theoretical coin-out meter and the relation of metered theoretical coin-out to persistence states achieved during play of one embodiment of a persistence game running on an EGM according to the invention. As each event listed on the left-hand column occurs, corresponding values for C-I, C-O, and COth are adjusted, as required. In this particular persistence game, a player must achieve five of the same type of "scatter pay" outcomes on a primary game of the EGM to fulfill the persistence criteria. A scatter pay outcome may be, for example, a hand greater than a pair of aces in a poker game. That is, a scatter pay outcome will occur for a hand containing two pair, three-of-a-kind, straight, flush, full house, straight flush, four-of-a-kind, or a royal flush. If a player achieves five occurrences of any one of those types of hands, then persistence criteria is satisfied, and a persistence award is disbursed.

Some persistence awards may be more valuable than others. For example, the odds are greater that a player will achieve five hands of three-of-a-kind than five hands of royal flush. The persistence award based on three-of-a-kind will therefore be much less than the persistence award for royal flush. Over a long period of time, however, an average expected value of a persistence award for any persistence game can be accurately calculated. In the example presented in Table 1, below, the average expected value of the persistence award is $100, and each of the five scatter pay outcomes adds $100/5=$20 to the theoretical coin-out of the EGM. That is, the values for the first four persistence states are $20, $40, $60, and $80. When the fifth and final persistence state is achieved, an actual persistence value is awarded and the persistence value of the fifth state is reset to zero.

The value of each persistence state may be determined (or calculated) according to a "ValueOf" function stored in the persistence game. The ValueOf function may calculate the persistence value, or the expected value of a persistence state. In one embodiment, the persistence values returned by the ValueOf function for persistence states leading to a common persistence award are incremented evenly. That is, the difference in value between any two sequential persistence states is constant. In another embodiment, the persistence values returned by the ValueOf function for persistence states leading to a common persistence award may be incremented unevenly.

In one embodiment the amount added, COth(+), by the theoretical coin-out meter to the previous value COth, may be determined at any persistence state according to:

$$COth(+)=\text{persistence award}+\text{ValueOf(Current State)}-\text{ValueOf(Previous State)} \quad (1)$$

For example, at the initiation of the persistence game at event 1, the EGM meters (i.e. the coin-in, coin-out, and theoretical coin-out meters, respectively denoted C-I, C-O, and COth), are clear. That is, they are each set to a value of zero. At event 2, a player wagers $1 and this value is added to C-I. At event 3, an outcome on the primary game of the persistence game awards the player of $0.75, and the value of this win is added to C-O and COth. At event 4, the player again wagers $1 and this amount is added to C-I. At event 5, an outcome on the primary game of an EGM achieves the first persistence state in the persistence game. According to eq. (1), the amount added to COth is the value of the persistence award disbursed ($0) plus the value of the current persistence state ($20) minus the value of the previous persistence state ($0)=$20. This amount is added to the $0.75 value stored as COth to arrive at the updated value of $20.75.

Game play continues in events 6 through 12, with the value of actual wagers being added to C-I, the value of actual wins (i.e. payouts) being added simultaneously to C-O and COth, and the value of COth being updated according to equation (1) as each persistence state achieved. When each persistence state is achieved, the persistence game advances to that persistence state. In event 13, the fifth persistence state is achieved and all persistence criteria are satisfied. The persistence state is now worth the average persistence award ($100). In the final event 14, a persistence award of $175 is paid out the player, which is a win that happens to be greater than the average expected value of $100. Other persistence awards achievable on the persistence game may have persistence awards greater than, equal to, or less than the expected persistence value. At event 13, $175 is added to C-O, the ValueOf the current persistence state is set to zero, and the amount added to COth is determined according to eq. (1):

$$\begin{aligned} COth(+) &= \$175 + ValueOf(\text{persistence state } 0) - \\ &= ValueOf(\text{persistence state } 5) \\ &= \$175 + \$0 - \$100 \\ &= \$75 \end{aligned}$$

This amount, $75, is added to the $101.50 stored as COth to arrive at a new value for COth=$176.50.

TABLE 1

| Event | EGM C-I | EGM C-O | EGM COth |
|---|---|---|---|
| 1. Meters clear | $0.00 | $ 0.00 | $ 0.00 |
| 2. Play $1, add $1 to Coin-In | $1.00 | $ 0.00 | $ 0.00 |
| 3. Win $0.75, add to Coin-Out and to Coin-Out-Th. | $1.00 | $ 0.75 | $ 0.75 |
| 4. Play $1, add $1 to Coin-In | $2.00 | $ 0.75 | $ 0.75 |
| 5. Hit 1st scatter pay to advance persistence game, add $20 to Coin-Out-Th. | $2.00 | $ 0.75 | $ 20.75 |
| 6. Play $1, add $1 to Coin-In | $3.00 | $ 0.75 | $ 20.75 |
| 7. Win $0.75 and hit 2nd scatter pay to advance persistence game. Add $20.75 to Coin-Out-Th. | $3.00 | $ 1.50 | $ 41.50 |
| 8. Play $1, add $1 to Coin-In | $4.00 | $ 1.50 | $ 41.50 |
| 9. Hit 3rd scatter pay to advance persistence game, add $20 to Coin-Out-Th. | $4.00 | $ 1.50 | $ 61.50 |
| 10. Play $1, add $1 to Coin-In | $5.00 | $ 1.50 | $ 61.50 |
| 11. Hit 4th scatter pay to advance persistence game, add $20 to Coin-Out-Th. | $5.00 | $ 1.50 | $ 81.50 |
| 12. Play $1, add $1 to Coin-In | $6.00 | $ 1.50 | $ 81.50 |
| 13. Hit 5th scatter pay to advance persistence game, add $20 to Coin-Out-Th. | $6.00 | $ 1.50 | $101.50 |
| 14. Persistence game plays and awards $175. Clear ValueOf state. Add to Coin-Out-Th.: $175 + [ValueOf(current state)($0) − ValueOf(previous state)($100)] = $75 | $6.00 | $176.50 | $176.50 |

In the above example, if the player stops playing the persistence game before satisfying all persistence criteria, unawarded persistence values remain stored in the theoretical coin-out meter. The EGM may record the persistence state data corresponding to the latest persistence state achieved in a player account (e.g., by transmitting persistence state information to another device via a network interface), on a portable machine-readable medium such as a ticket, a card, etc. These persistence state data may be later retrieved, so that the player may resume the persistence game at the same or another EGM, at the persistence state corresponding to the latest persistence state achieved.

Figure 4:
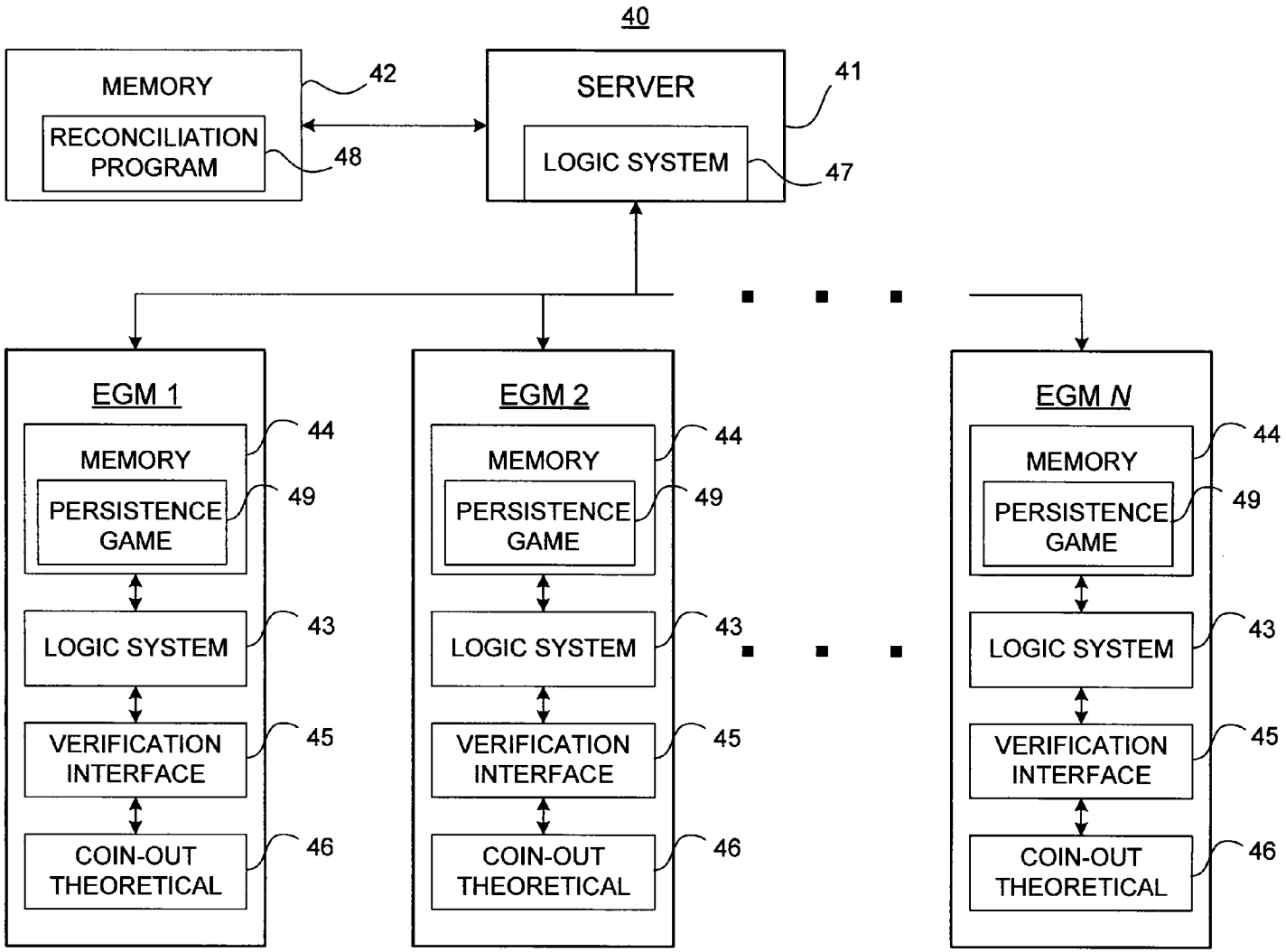
FIG. 4 is a block diagram of one embodiment of an electronic gaming system according to the invention having one or more groups of machines each configured to run a personal persistence game.

FIG. 4 shows a block diagram of one embodiment of an electronic gaming system 40 according to the invention having one or more groups of machines each configured to run a personal persistence game. The system 40 allows RTP values to be calculated for individual EGMs that at any point in time may store unawarded persistence values in a theoretical coin-out meter. In system 40, a clearinghouse server 41 includes a logic system 47 comprising one or more processors configured for communication with a group of gaming machines EGM 1, EGM 2, . . . EGM N. Server 41 is further configured to run a reconciliation program 48 that is stored in a memory 42 that is configured for communication with the logic system of the server. The reconciliation program 42 may be more specifically described as a persistence value reconciliation program, and may comprise a series of instructions stored in machine-readable memory 42 executable by logic system 47. The clearinghouse program when run, allows the server to read information stored in the group of EGMs to allow the server to reconcile a persistence award redeemed at any one of the EGMs with unawarded persistence values accumulated at other EGMs within the group.

EGM 1, EGM 2 . . . EGM N may be electronic gaming machines configured to run persistence games according to the invention. Each EGM may include a logic system 43 configured for communicating with server 41 and with a memory 44. Memory 44 may include at least one persistence game 49 in the form of computer readable software executable by the logic system 43 for running the persistence game. The persistence game may have one or more recordable persistence states that, when fulfilled during game play, lead to a persistence award that may be disbursed by the EGM or otherwise redeemed by the player. Each of the persistence states may be associated with a particular persistence value that represents a portion of the persistence award, and the persistence values may also be stored in the memory 44. A characteristic of the persistence game 49 is that it may be interrupted at any time at a first EGM in the group, and later resumed at a second EGM in the group, and when resumed the game may start play at the second EGM at a persistence state previously recorded on the first EGM.

The gaming machines EGM 1, EGM 2 . . . EGM N each further include a verification interface 45 and a theoretical coin-out meter 46. Verification interface 45 may be configured for communication with logic system 43, and may operate as described above with reference to EGM 20. To initiate game play of the persistence game 49 at one of the EGMs, verification interface 45 may first receive information to allow the interface to determine whether to begin the persistence game at an advanced persistence state that was previously achieved during play of the persistence game at the same or a different EGM in the group. For example, the verification interface may read information regarding previously achieved persistence states from a player portable instrument, or it may read the information from a player account stored in a memory accessible by server 41. The information read may be data representing unawarded persistence values. If the verification interface 45 determines that the player has accumulated unawarded persistence values, or is otherwise entitled to begin the persistence game at an advanced state, it may permit the initiation of the game at that state through communication with logic system 43.

Theoretical coin-out meter 46 operates as described above with reference to EGM 30, and may comprise hardware integral with the logic system 43 and/or software stored in memory 44 as computer readable instructions executable by the logic system. Theoretical coin-out meter 46 may store in memory 44 unawarded persistence values accumulated by the EGM through advancing persistence states achieved though persistence game play.

In reconciling unawarded persistence values with redeemed persistence awards, the persistence value reconciliation program 48 may poll the group of gaming machines for actual coin-out values and theoretical coin-out values, subtract a sum of the actual coin-out values of the group of gaming machines from a sum of the theoretical coin-out values of the group of gaming machines to obtain a difference, and reconcile the group of EGMs according to whether the difference is positive or negative. If the difference is positive, the persistence value reconciliation program 48 may credit the group of EGMs an amount equal to the difference. If the difference is negative, the persistence value reconciliation program 48 may charge the group of EGMs an amount equal to the difference. The subtracting and reconciling steps may be performed by the clearinghouse server 41 on a per-group basis, on a per-machine basis, or on any other convenient basis.

Table 2 shows an example of persistence game play in a gaming system 40 by a single player playing the same persistence game on different EGMs in the system. In this example, the player must achieve two persistence game outcomes to award an average persistence award (over time) of $20. Each scatter pay outcome adds $20/2=$10 to the theoretical coin-out.

TABLE 2

| | EGM 1 | | | EGM 2 | | | Sum of EGMs | | |
|---|---|---|---|---|---|---|---|---|---|
| Event | C-I | C-O | COth | C-I | C-O | COth | C-I | C-O | COth |
| 1. Player starts at EGM 1 | $0 | $0 | $ 0 | $0 | $ 0 | $ 0 | $0 | $ 0 | $ 0 |
| 2. Play $1 | $1 | $0 | $ 0 | $0 | $ 0 | $ 0 | $1 | $ 0 | $ 0 |
| 3. Win $2 | $1 | $2 | $ 2 | $0 | $ 0 | $ 0 | $1 | $ 2 | $ 2 |
| 4. Play $1 | $2 | $2 | $ 2 | $0 | $ 0 | $ 0 | $2 | $ 2 | $ 2 |
| 5. Persistence State Advances | $2 | $2 | $12 | $0 | $ 0 | $ 0 | $2 | $ 2 | $12 |
| 6. Player Leaves | $2 | $2 | $12 | $0 | $ 0 | $ 0 | $2 | $ 2 | $12 |
| 7. Player moves to EGM 2 | $2 | $2 | $12 | $0 | $ 0 | $ 0 | $2 | $ 2 | $12 |
| 8. Play $1 | $2 | $2 | $12 | $1 | $ 0 | $ 0 | $3 | $ 2 | $12 |
| 9. Persistence State Advances | $2 | $2 | $12 | $1 | $ 0 | $10 | $3 | $ 2 | $22 |
| 10. Persistence Criteria Fulfilled Game wins $25 Clear Persistence state | $2 | $2 | $12 | $1 | $25 | $15 | $3 | $27 | $27 |

In this example at event 5, the player achieves the first persistence state on EGM 1 and an amount of $10 is added to CO(th) of EGM 1. The player ends the game and later ends moves to EGM 2. EGM 2 verifies that the player has accumulated an unawarded persistence value on another EGM in the system, and resumes the persistence game at the persistence state corresponding to the unawarded persistence value. At event 10, the player fulfills the persistence criteria and EGM 2 disburses a $25 persistence award. In effect, EGM 1 has incurred a $10 liability to EGM 2 for coin-out that is recorded in the theoretical coin-out meter for EGM 1. In this case, RTP calculated as C-O/C-I, particularly as to a single EGM, would provide unrealistic results. To arrive at an accurate calculation of RTP for EGMs running persistence games according to the invention, RTP may be calculated as CO(th)/C-I, which over a long period of time should converge to the theoretical RTP of the machine.

By tracking coin-in, coin-out, and theoretical coin-out for each EGM, the server 41 may later run the clearinghouse program 42 to reconcile the accumulation of unawarded persistence values stored as CO(th) on EGMs in the group with the accumulation of redeemed persistence awards stored as C-O on other EGMs in the group. For a particular EGM, the difference between CO(th) and C-O will represent the accumulated unawarded persistence value (if the difference is positive) or the accumulated redemption of persistence awards (if the difference is negative). The combined RTP among all EGMs in the group may be calculated, for example, by clearinghouse program 42 summing C-I and CO(th) for the entire group, as shown in the right-most columns of Table 2, and computing the CI to CO(th) ratio. The net accumulated persistence values among a group of EGMs (EGM 1, EGM 2, . . . EGM N) may be tracked in this manner.

According to some embodiments of the invention, it is possible for a group of individual casinos to run persistence games on EGMs and allow players to start a persistence game at one of the casinos, accumulate unawarded persistence value, and later resume the persistence game at another one of the casinos. The casinos may then use the invention to reconcile each one's obligation to the others by comparing their net accumulated persistence values. An example of persistence game play by a player moving between two casinos is shown in Table 3. In this example, the player must achieve two persistence game outcomes to award an average persistence award (over time) of $20. Each persistence state adds $20/2=$10 to the theoretical coin-out.

The example in Table 3 is similar to the previous example, except that in event 11, a clearinghouse operation reconciles payout obligations between the participating casinos. Although the example in Table 3 tracks persistence values accumulated in a single persistence game, the clearinghouse concept may be extended to reconcile net persistence values accumulated from running multiple persistence games among EGMs at one casino with net redemptions of persistence awards accumulated from running multiple persistence games among EGMs at other casinos.

In another aspect of the invention, the clearinghouse operation may be performed by a centralized accounting agent. The agent may be an independent entity, or a clearinghouse server operated by one of the casinos or by a third party having no ownership interest in the gaming machines. The clearinghouse may be, or may interface with, a financial institution such as a bank that can maintain a holding account. The holding account may issue credit that accumulates when theoretical wins exceed actual wins, and record debt that accumulates when actual wins exceed theoretical wins. Persistence values for persistence games are determined according to the invention so that over time, the theoretical wins and actual wins will converge to be identical or nearly identical. The clearinghouse may charge a service fee to participating casinos for maintaining the holding account and reconciling payouts with unawarded persistence values.

Figure 5:
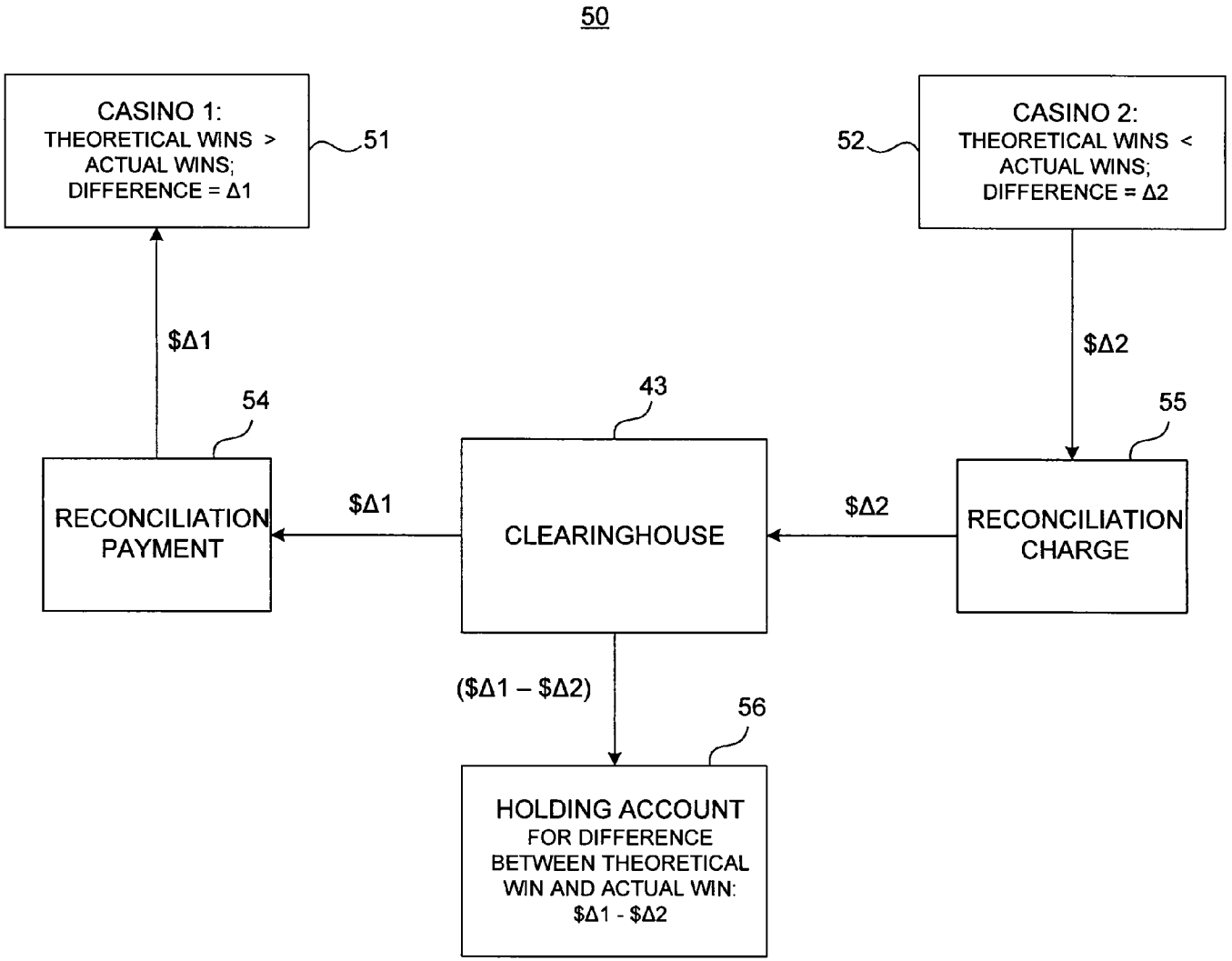
FIG. 5 is a conceptual block diagram illustrating a clearinghouse process according to one embodiment of the invention for reconciling payback percentages among a plurality of casinos operating banks of EGMs running personal persistence games.

The clearinghouse concept is depicted in the block diagram of FIG. 5, which illustrates a clearinghouse system 50. System 50 includes a central clearinghouse server or agent 43 configured to reconcile theoretical wins with actual wins among a plurality of casinos 51 and 52 operating EGMs that run persistence games according to the invention. For ease of illustration only, and not by way of limitation, system 50 depicts only two casinos, however, the clearinghouse concept may be applied to multiple casinos served by the central clearinghouse 43. The multiple casinos may be owned by the same entity or by different entity, and may be located in the same jurisdiction or in more than one jurisdiction.

Clearinghouse 50 may communicate with each of the participating casinos 51 and 52 to periodically (e.g. on a weekly, monthly, or yearly basis) reconcile actual wins with theoretical wins among banks of EGMs running persistence games. Clearinghouse 50 may communicate with each casino by querying the coin-in, coin-out, and/or theoretical coin-out meters of the EGMs and summing the results, for example, as shown in the Sum of EGMs column in Table 2. Clearinghouse

TABLE 3

| | | Casino A | | | Casino B | | |
|---|---|---|---|---|---|---|---|
| | Event | C-I | C-O | COth | C-I | C-O | COth |
| 1. | Player starts at Casino A | $0 | $0 | $ 0 | $0 | $ 0 | $ 0 |
| 2. | Play $1 | $1 | $0 | $ 0 | $0 | $ 0 | $ 0 |
| 3. | Win $2 | $1 | $2 | $ 2 | $0 | $ 0 | $ 0 |
| 4. | Play $1 | $2 | $2 | $ 2 | $0 | $ 0 | $ 0 |
| 5. | Persistence State Advances | $2 | $2 | $12 | $0 | $ 0 | $ 0 |
| 6. | Player Leaves | $2 | $2 | $12 | $0 | $ 0 | $ 0 |
| 7. | Player moves to Casino B | $2 | $2 | $12 | $0 | $ 0 | $ 0 |
| 8. | Play $1 | $2 | $2 | $12 | $1 | $ 0 | $ 0 |
| 9. | Persistence State Advances | $2 | $2 | $12 | $1 | $ 0 | $10 |
| 10. | Persistence Criteria Fulfilled. Game wins $25 from a theoretical avg. win of $20 | $2 | $2 | $12 | $1 | $25 | $15 |
| 11. | Reconciliation: | Clearinghouse charges $10 to Casino A since it accumulated $12 in the persistence game and paid $2. | | | Clearinghouse reimburses $10 to Casino B since it accumulated a theoretical value of $10 in the game and paid a win with a theoretical value of $20. | | |

50 may then perform a reconciliation process by comparing theoretical wins recorded by the casino in theoretical coin-out meters to actual wins recorded by the casino in coin-out meters. If theoretical wins exceed actual wins, as in the case of casino 51, the clearinghouse determines that the difference, Δ1, represents an amount owed by the clearinghouse to casino 51. In this case, the reconciliation process 54 distributes a reconciliation payment of $Δ1 to casino 51. If however, actual wins exceed theoretical wins, as in the case of casino 52, the clearinghouse determines that the difference, Δ2, represents an amount owed to the clearinghouse by casino 52. In this case, the reconciliation process 55 charges a reconciliation fee of $Δ2 to casino 52.

In practice, the values obtained during any reconciliation period for Δ1 and Δ2 will often be unequal. According to the invention, the clearinghouse 43 may maintain a holding account 56 to account for the difference between the two values. Because theoretical coin-out converges over time to actual coin-out, the difference Δ1-Δ2 will fluctuate between positive and negative amounts, but in the long term should converge toward zero.

Keeping in mind the foregoing structures of systems and apparatus according to the invention that include one or more EGMs running persistence games and tracking unawarded persistence values in theoretical coin-out meters, processes according to the invention are now disclosed for operating personal persistence games to enable reconciliation of persistence values accumulated and awarded among multiple EGMs.

Figure 6:
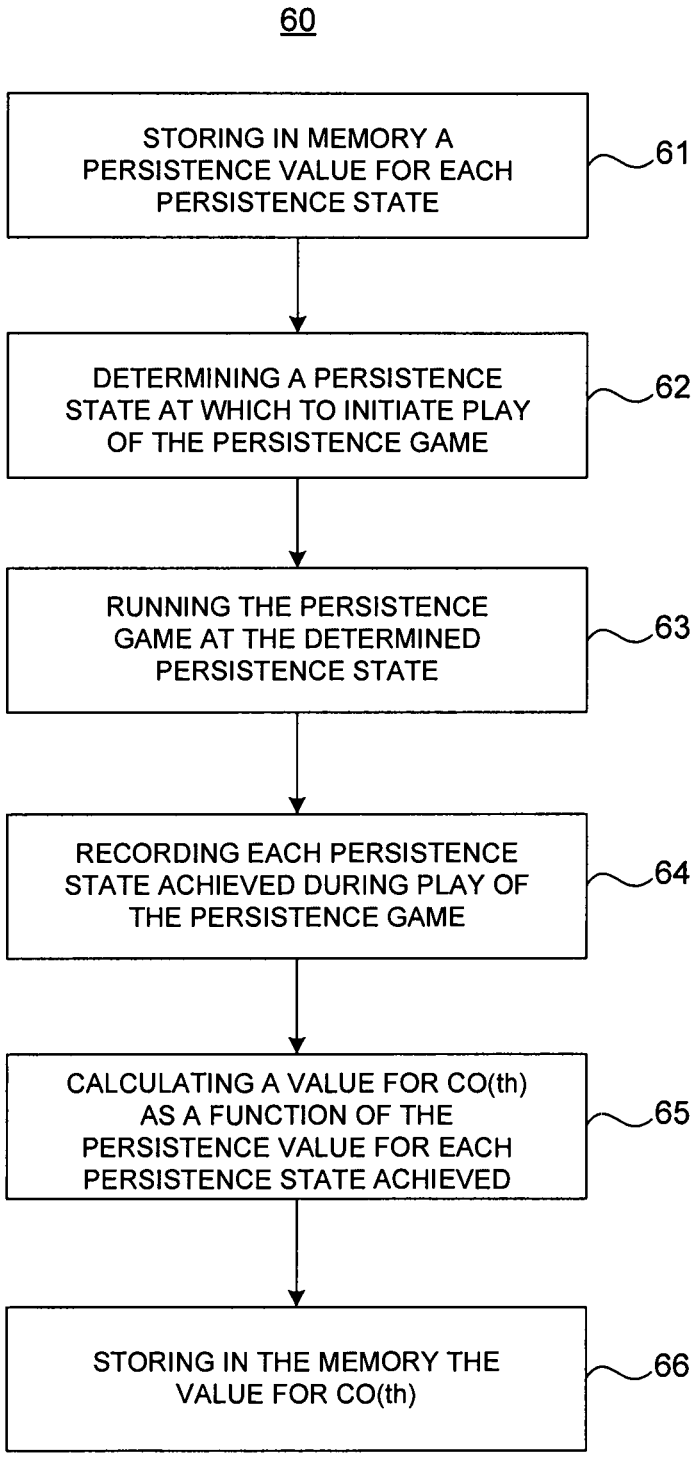
FIG. 6 is a flow chart illustrating a process according to one embodiment of invention for operating a personal persistence game to enable reconciliation of persistence values achieved on a first EGM with persistence awards redeemed on a second EGM.

FIG. 6 shows a process 60 as a series of steps in a flow chart for operating a personal persistence game on an EGM. For purposes of illustration, the steps represent salient steps of the process, and it should be recognized that additional steps disclosed herein may be added to the process without departing from the scope of the invention. Process 60 may be implemented in an EGM having a logic system communicating with memory and configured to run a persistence game having one or more recordable persistence states transferable to another machine, where the persistence states lead to a redeemable persistence award when persistence criteria are satisfied.

The process begins at step 61, which includes storing in a memory accessible by the EGM a persistence value for each of the persistence states that are achievable during play of the persistence game. In the next step 62, the process includes determining a persistence state at which to initiate play of the persistence game on the EGM. In one embodiment this step may be performed in response to a player inserting a player portable instrument readable by the EGM, that stores data representing a persistence state previously achieved by the player. In another embodiment, this step may be performed by the EGM in response to a player logging in to a player account. If there was no previously achieved persistence state determinable, this step may include starting the persistence game at a beginning state where no persistence values have accumulated. The next step 63 includes running the persistence game at the persistence state determined in the previous step. The next step 64 includes recording each persistence state achieved during play of the persistence game. For example, the states may be recorded in memory accessible by the EGM, or on a player portable instrument. The next step 65 provides for calculating a value CO(th) for theoretical coin-out as a function of the persistence value for each persistence state achieved. This step may be performed in a manner consistent with equation (1). In the last step 66, the process provides for storing in the EGM memory the value for CO(th) calculated in the previous step.

Figure 7:
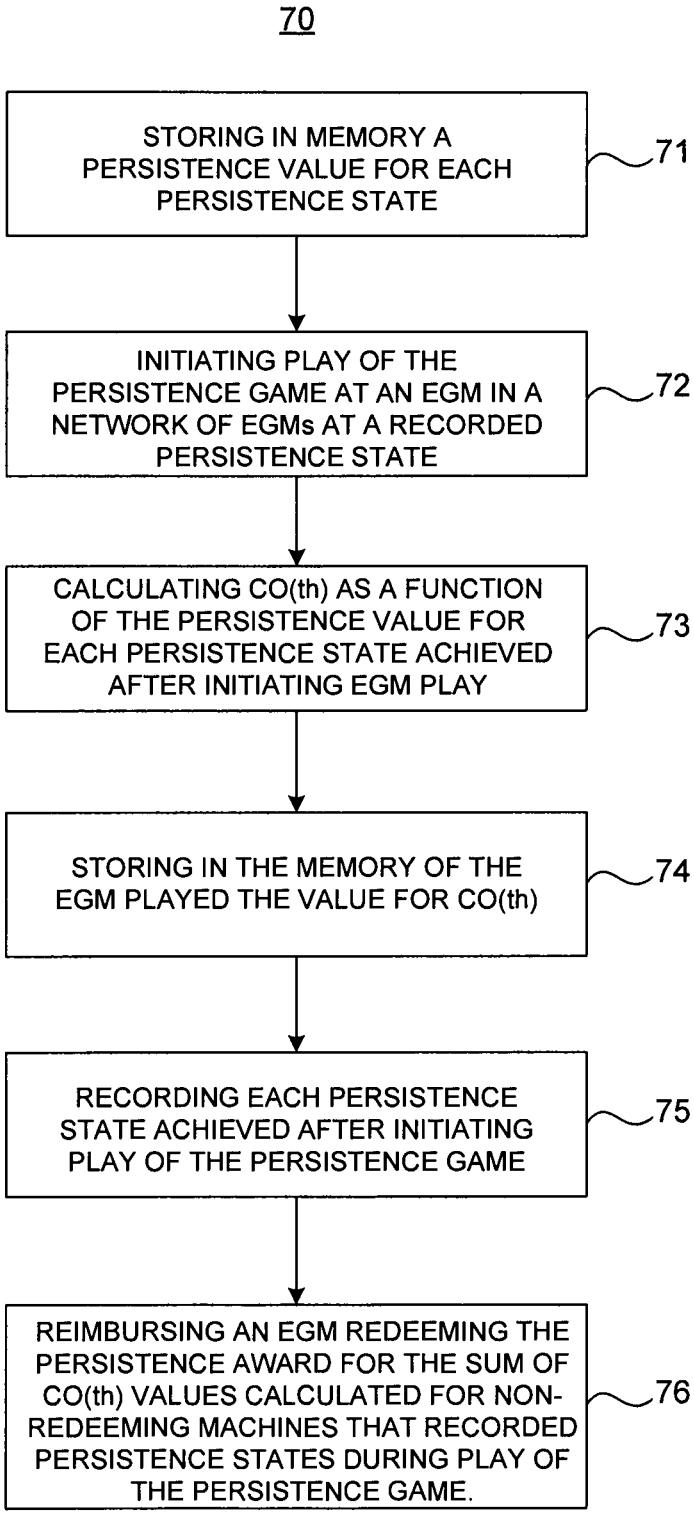
FIG. 7 is a flow chart illustrating a process according to one embodiment of invention for reconciling payback percentage attributable to one or more EGMs in a network of EGMs with a persistence award redeemed on another EGM in the network.

FIG. 7 shows a process 70 as a series of steps in a flow chart for operating personal persistence games in a network of EGMs to allow for reconciliation of payback percentage attributable to one or more of the EGMs in the network with a persistence award redeemed on another EGM in the network. For purposes of illustration, the steps represent salient steps of the process, and it should be recognized that additional steps disclosed herein may be added to the process without departing from the scope of the invention. Process 70 may be implemented in an EGM network in which each EGM includes a logic system having at least one processor configured for communication with a server, and having a computer readable memory configured to communicate with the logic system, the memory including instructions executable by the logic system for running on the gaming machine a persistence game having one or more recordable persistence states, where the persistence states lead to a redeemable persistence award when all persistence criteria are satisfied.

Process 70 begins at step 71, which includes storing, in a memory accessible by an EGM in the network, a persistence value for each of the persistence states, where each persistence value stored represents a portion of the persistence award in the persistence game. The next step 72 includes initiating play of the persistence game at any one of the EGMs in the network at a recorded persistence state. The next step 73 includes calculating, for each EGM played, a value for theoretical coin-out as a function of the persistence value for each persistence state achieved after initiating play of the persistence game. In the next step 74, the value for theoretical coin-out is stored in the memory of the corresponding EGM played. The next step 75 includes recording each persistence state achieved after initiating play of the persistence game. The final step 76 provides for reimbursing an EGM redeeming the persistence award by an amount equal to the sum of theoretical coin-out values calculated for non-redeeming machines that recorded persistence states during play of the persistence game.

In implementing a system or method according to the invention, from time to time unredeemed persistence awards may need to be expired from an EGM or from a player account. As such accounts expire, most gaming jurisdictions require that the value of those accounts be returned to the gaming public. The invention provides a mechanism to return that value to the gaming public (although not necessarily to the same player). In some embodiments the expired values may be divided into values returned to individual jurisdictions separately. Such returned values may be accounted for as redemptions in the reconciliation schemes described above.

Figure 8A:
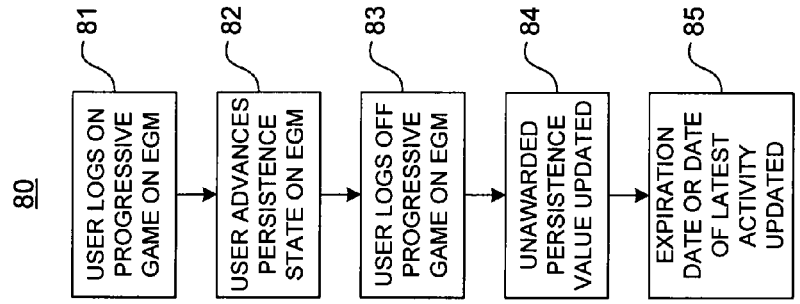
FIG. 8A is a flow chart illustrating a process according to one embodiment of the invention whereby an individual player may update in a player account persistence states achieved in a personal persistence game.

FIG. 8A shows an aspect of the invention in the form of a flow chart illustrating a process 80 whereby an individual player (or user) may update in a player account persistence states achieved in a personal persistence game. In process 80, it is contemplated that the persistence game may form part of a progressive game in which unredeemed or persistence values may be eventually contributed toward a pool awardable in the progressive game when the player account expires. In the first step 81, a player logs on to a player account (or creates a new account) on an EGM to play a progressive game which includes a persistence game. The log-on procedure may involve a verification interface verifying whether a player account exists and determining whether to initiate play at a persistence state previously stored in the account. In one embodiment the player account may be an anonymous account associated with a player portable instrument, such as a printed ticket or a computer readable card. In the next step 82, the player may advance the recorded persistence state by playing the game. In the next step 83, the player logs off or quits playing the progressive game. In the next step 84, the unawarded persistence value for the account is updated. In the final step, the expiration date or date of last activity associated with the player account is updated. It should be appreciated that in this manner, large numbers of players may create player accounts and accumulate unawarded persistence values. Eventually, for accounting purposes, a casino may need to expire some of these accounts after predetermined periods of inactivity.

Figure 8B:
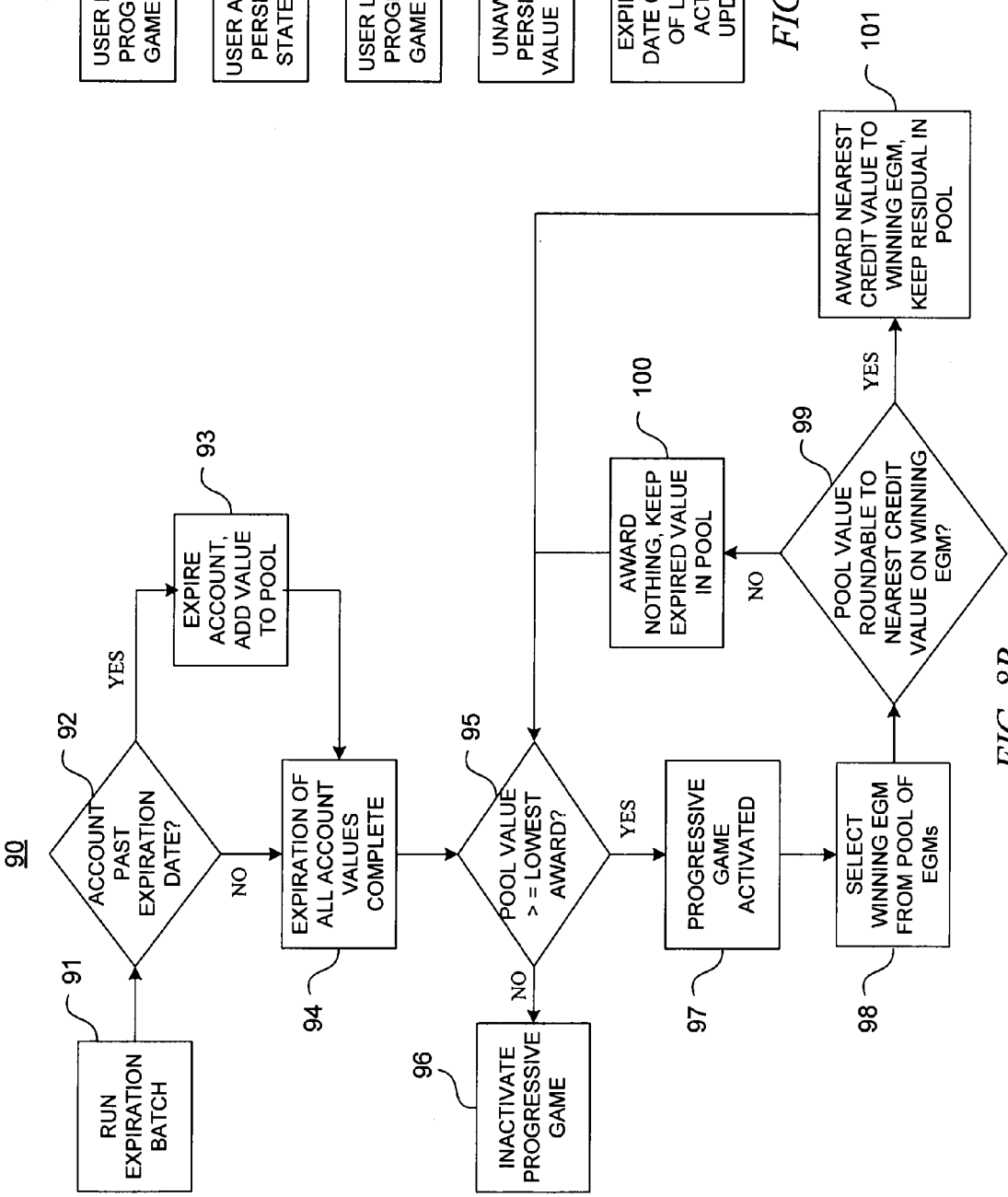
FIG. 8B is a flow chart illustrating a process according to another embodiment of the invention for reconciling unawarded persistence values in expired player accounts with progressive pool awards.

FIG. 8B shows one embodiment of a process 90 according to the invention for reconciling unawarded persistence values in expired player accounts with progressive pool awards. Process 90 may begin at step 91, which involves running an expiration batch program at some periodic interval, such as monthly. The batch program may be run, e.g., on a server that has access to player account information stored in memory. In step 92, the batch program examines each player account and compares the expiration date or date of last activity (e.g. as determined in step 85) with a current date to determine whether the account has expired. If so, the process moves to step 93. In step 93, the value of the expired account, that is, the value of all unawarded persistence states, is added to a progressive pool of a progressive game. The progressive game need not be directly associated with the persistence game from which the persistence states were achieved. The batch program then examines another player account for expiration, and eventually progresses to step 94. Returning to step 92, if the player account being examined is not expired, the account remains active, and the method eventually progresses to step 94. Step 94 represents a state in the batch program at which all player accounts have been examined for expiration and all persistence values in expired player accounts have been added to the progressive pool.

Next, in step 95, the process checks the current value stored in the progressive pool for a value equal to or greater than the lowest awardable value in the progressive game. If no such value exists, the process moves to step 96 and inactivates the progressive game. If such a value does exist, the process moves to step 97 and activates the progressive game. Next, in step 98, the server selects one of the EGMs in the bank of EGMs as the winner of the progressive pool. The criteria for determining the winning EGM may be by random selection or by the fulfillment of some predetermined criteria for winning the progressive pool.

Next, in step 99, the process determines whether the pool value is roundable to the nearest credit value on the winning EGM. If not, the process moved to step 100. In step 100, nothing is awarded, and the sum of expired persistence values remains in the progressive pool. The process then loops back to step 95. In this manner, over time, a method 90 according to the invention may return unawarded persistence values to the gaming public and reconcile persistence values accumulated in EGMs with actual payouts. In step 99, if the process determines that the pool value is roundable to the nearest credit on the winning EGM, then the process moves to step 101 and the nearest credit value is awarded by the winning EGM. Any residual value remains in the progressive pool, and the process loops back to step 95.

In another embodiment, instead of adding the value of an expired player account to a progressive jackpot, the batch process could add value to non-expired player accounts. To do this, the process may select a player account according to pre-established criteria (e.g. randomly, by loyalty ranking, according to an incentive award, or by some combination thereof) to which to add value. The process may calculate the value added as the ValueOf (Next persistence state)-ValueOf (current persistence state). If the value added is less than or equal to the value to be disbursed from expired accounts, it may change the peresistance state of the non-expired account from the current state to the next state, and may subtract the value added from the value to be disbursed from expired accounts.

A system or method according to the invention may also provide for collection of account values by players after normal means of collection are no longer valid. For example, a reality of casino operations is that operators often remove EGMs from the casino floor. An EGM scheduled for removal may provide the last normal means for a player to redeem account value, for example, if the EGM is the only one remaining that is configured to run a particular persistence game. Once that EGM is removed, then a method of the invention may allow for a player to transfer unawarded persistence value into a credit or cash value. For example, the player may log in to another EGM, and during the login sequence the EGM may determine whether there are persistence values in the player account that are unawardable by normal means. The EGM may then offer to disburse an equivalent cash value to the player, or it may offer to convert the unawarded value to equivalent unawarded persistence value associated with a playable persistence game. Since any disbursement of account value will likely be handled at an EGM, this will be considered a redemption in the reconciliation schemes described herein.

A system or method according to the invention may also provide for merging of value from separate accounts, or transferring value from one account to another. For example, a player may open different player accounts at different casinos, and eventually desire to consolidate accumulated persistence values in a single account. Or the player may have in his possession multiple anonymous player portable instruments storing unawarded persistence values. Or related players (such as a husband and wife, or members of the same junket) may wish to consolidate persistence awards. The values merged or consolidated may be tracked by a server according to the invention.

In another aspect of the invention, a first EGM need not run the same persistence game as a second EGM for a player to redeem a persistence award at the second EGM, for which persistence value was earned on the first EGM. In this situation, a player may convert a stored persistence state associated with a first persistence game to a persistence state of a second persistence game having a commensurate persistence value. In another aspect of the invention, if a persistence award exists on the second persistence game that has a value commensurate with the unawarded persistence value from the first game, the second EGM may give the player an option to convert the partially completed persistence game state from the first game into a completed persistence game state in the second game. In this case, the second game may allow the player to immediately take the persistence award.

In another aspect of the invention, a persistence game which awards persistence values may specify a maximum convertible state that is less than the value of the unawarded persistence state achieved. A player converting unawarded persistence value from one game to another may then convert up to the maximum convertible state. This prevents players from accumulating a persistence state on one game, then converting to another persistence game where the progressive award exceeds the average value of their current persistence game state. In one embodiment, for such a conversion, the ValueOf (the converted persistence state) may not exceed 100.5% of the ValueOf (the original persistence state).

Persistence states achievable in a persistence game according to the invention may represent an accumulation of points, objects, symbols, or other outcomes from a base game that progress toward the persistence award. Each play of the base game, i.e., the coin-in, makes a contribution toward funding the persistence game, which contribution may be determined by the game designer. For example, a contribution of 1% of every wager made in the base game may be selected to fund the persistence game awards. The average value of a persistence award may be determined as a function of the average number of base games, G, that must be played to reach the persistence award, the average wager (or minimum required wager for persistence game eligibility), W, made on the EGM, and the contribution percentage, C, of the wager reserved for the persistence game awards. According to the invention, the average value, A, of a persistence award may be calculated as:

$$A=G*W*C \tag{2}$$

The value, S, of a saved persistence state can then be computed as:

$$S=A-G'*W*C \tag{3}$$

where G' represents the average number of base games left to be played to reach the persistence award. The average number of games left to be played, G', varies depending on the style of the persistence game. Several variations are now described. In each variation, N represents the number of items to be collected and I represents the average number of items collected per game (or equivalently, the probability of an item being collected).

First Variation: Collecting N Identical Items

The first variation occurs in a persistence game in which the player must collect a number, N, of identical items to reach a persistence award. For example, the player must collect N points, N occurrences of a scatter symbol, N wins, N losses, or N outcomes that meet a certain criteria. The number of games required to collect N items is given by $$G'=N/I$$

Second Variation: Collecting N Different Items in any Order, Items Drawn without replacement The second variation occurs in a persistence game in which the player must collect N different items (e.g. three properties of the same color in Monopoly). When the player collects an item, it is drawn randomly out of all items which the player has yet to collect. The number of games required to collect N items is given by $$G'=N/I$$

Third Variation: Collecting N Different Items, in Order, Items Drawn without Replacement The third variation occurs in a persistence game wherein, when the player receives an item, it is drawn randomly out of all items which the player has yet to collect. The player needs a specific next item and if the item drawn is not that specific item, the persistence state does not advance. The number of games required to collect N items is given by the following equation items is given by the following $$G' = 1/I*\sum_{j=1}^{j=N} j = N*(N+1)/(2*I)$$

Fourth Variation: Collecting N Different Items, any Order, Items Drawn with Replacement The fourth variation occurs in a persistence game wherein, when the player receives an item, it is drawn randomly out of all possible items, without regard to the items the player has already collected. "Drawing with replacement" means that items drawn out of the pool are put back into the pool for the next draw. If the player already has that item, the persistence state does not advance. The number of games required to collect N items is:

$$G' = N/I*\sum_{j=1}^{j=N}(1/j)$$

Fifth Variation: Collecting N Different Items, in Order, Items Drawn with Replacement:

The fifth variation occurs in a persistence game wherein, when the player receives an item, it is drawn randomly out of all possible items, without regard to the items the player has already collected. If the item drawn is not the item the player needs, the persistence state does not advance. The number of games required to collect N items is:

$$G'=N*N/I$$

Some networks described herein provide methods and devices for managing one or more networked gaming establishments. Such networks may sometimes be referred to herein as server-based gaming networks, Sb™ networks, or the like. Some such gaming networks described herein allow for the convenient provisioning of networked gaming machines and other devices relevant to casino operations. Game themes may be easily and conveniently added or changed, if desired. Related software, including but not limited to player tracking software, peripheral software, etc., may be downloaded to networked gaming machines, mobile gaming devices, thin clients and/or other devices, such as kiosks, networked gaming tables, player stations, etc.

In some implementations, servers or other devices of a central system will determine game outcomes and/or provide other wager gaming functionality. In some such implementations, wagering games may be executed primarily on one or more devices of a central system, such as a server, a host computer, etc. For example, wager gaming determinations (such as interim and final game outcomes, bonuses, etc.) may be made by one or more servers or other networked devices. Player tracking functions, accounting functions and even some display-related functions associated with wagering games may be performed, at least in part, by one or more devices of a casino network and/or of a central system.

Figure 9:
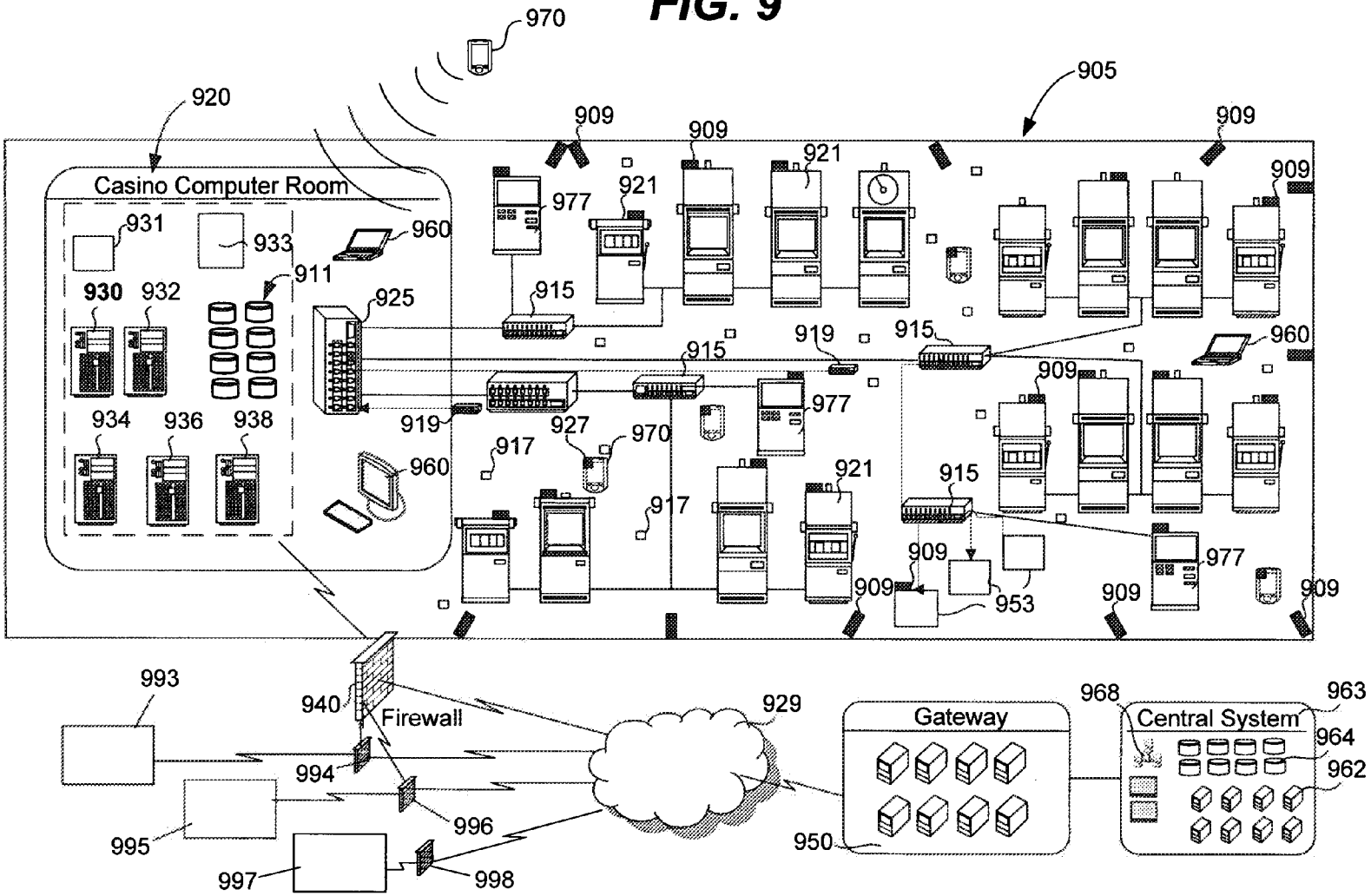
FIG. 9 is an illustration of gaming establishment networks, configured for communication with a central system, including examples of components that may be configured to perform some functions described herein.

One example of an Sb™ network is depicted in FIG. 9. The architecture and specific devices shown, as well as the related functionality, are merely examples. Here, casino computer room 920 and networked devices of a gaming establishment 905 are illustrated. Gaming establishment 905 is configured for communication with central system 963 via gateway 950. Gaming establishments 993, 995 and 997 are also configured for communication with central system 963.

Gaming establishment 905 includes multiple gaming machines 921. Some of gaming machines 921 form a cluster or "bank" 910 of gaming machines 921. In this example, at least some of gaming machines 921 are configured to provide persistence games and some include theoretical coin-out meters. Such gaming machines may be configured to calculate and compare theoretical RTP with actual RTP. Such gaming machines 921 are preferably configured for communication with one or more devices of casino computer room 920 (or similar devices disposed elsewhere in gaming establishment 905), e.g. for the purposes of obtaining persistence state information from a player account, updating persistence state information in a player account, obtaining and/or providing data for reconciling theoretical coin-out and actual coin-out, etc. Some of gaming machines 921 may be configured to read persistence state information from, and/or write persistence state information to, a portable instrument such as a ticket, a player loyalty device, etc. Moreover, some of gaming machines 921 may be configured for reconciling theoretical coin-out and actual coin-out for a group of gaming machines 921, for storing theoretical coin-out data of other gaming machines 921, etc.

In this example, gaming establishment 905 also includes a bank of networked gaming tables 953. However, the present invention may be implemented in gaming establishments having any number of gaming machines, gaming tables, etc. It will be appreciated that many gaming establishments include hundreds or even thousands of gaming machines 921, gaming tables 953 and/or mobile devices 970, not all of which are necessarily associated a bank and some of which may not be connected to a network. At least some of gaming machines 921 and/or mobile devices 970 may be "thin clients" that are configured to operate, at least in part, according to instructions from another device (such as a server).

Storage devices 911, Sb™ server 930, License Manager 931, Arbiter 933, servers 932, 934, 936 and 939, host device(s) 960 and main network device 925 are disposed within computer room 920 of gaming establishment 905. In practice, more or fewer devices may be used. Depending on the implementation, some such devices may reside elsewhere in gaming establishment 905.

One or more of the devices in computer room 920 (or similar devices disposed elsewhere in gaming establishment 905 or in gaming establishment 993, 995 or 997) may be configured to provide functionality relevant to the present invention. For example, one or more of servers 932, 934, 936 or 939 may be configured for communication with gaming machines 921 that are configured to provide persistence games and that include theoretical coin-out meters. For example, one or more such servers may be configured to provide persistence state information regarding a persistence game. Such persistence state information may be associated with a player and may be stored in a player account, e.g., in one of local storage devices 911. Alternatively, or additionally, player account data may be maintained by central system 963. One or more of servers 932, 934, 936 or 938 may be configured to reconcile theoretical and actual coin-out data for gaming machines 921 within gaming establishment 905 and/or between multiple gaming establishments.

Accordingly, in some embodiments at least some gaming establishments may be configured for communication with one another. In this example, gaming establishments 993 and 995 are configured for communication with casino computer room 920. Such a configuration may allow devices and/or operators in casino 905 to communicate with and/or control devices in other casinos. In some such implementations, a server (or another device) in computer room 920 may be configured to function as a clearinghouse server for reconciling actual coin-out and theoretical coin-out between gaming machines of casino 905 and devices in other gaming establishments. Conversely, devices and/or operators in another gaming establishment may communicate with and/or control devices in casino 905.

Some of these servers in computer room 920 may be configured to perform tasks relating to accounting, player loyalty, bonusing/progressives, configuration of gaming machines, etc. A Radius server and/or a DHCP server may also be configured for communication with the gaming network. Some implementations of the invention provide one or more of these servers in the form of blade servers. Some embodiments of Sb™ server 930 and the other servers shown in FIG. 9 include (or are at least in communication with) clustered CPUs, redundant storage devices, including backup storage devices, switches, etc. Such storage devices may include a "RAID" (originally redundant array of inexpensive disks, now also known as redundant array of independent disks) array, back-up hard drives and/or tape drives, etc.

In some implementations of the invention, many of these devices (including but not limited to License Manager 931, servers 932, 934, 936 and 938, and main network device 925) are mounted in a single rack with Sb™ server 930. Accordingly, many or all such devices will sometimes be referenced in the aggregate as an "Sb™ server." However, in alternative implementations, one or more of these devices is in communication with Sb™ server 930 and/or other devices of the network but located elsewhere. For example, some of the devices could be mounted in separate racks within computer room 920 or located elsewhere on the network. Moreover, in some implementations large volumes of data may be stored elsewhere, e.g., via a storage area network ("SAN").

Computer room 920 may include one or more operator consoles or other host devices that are configured for communication with other devices within and outside of computer room 920. Such host devices may be provided with software, hardware and/or firmware for implementing functions described herein. However, such host devices need not be located within computer room 920. Wired host devices 960 (which are desktop and laptop computers in this example) and wireless devices 970 (which are PDAs in this example) may be located elsewhere in gaming establishment 905 or at a remote location.

Some embodiments include devices for implementing access control, security and/or other functions relating to the communication between different devices on the network. In this example, Arbiter 933 serves as an intermediary between different devices on the network. Arbiter 933 may be implemented, for example, via software that is running on a server or another networked device. In some implementations, Arbiter 933 is a repository for the configuration information required for communication between devices on the gaming network (and, in some implementations, devices outside the gaming network).

One or more devices in central system 963 may also be configured to perform, at least in part, tasks specific to the present invention. For example, one or more servers 962, storage devices 964 and/or host devices 960 of central system 963 may be configured to implement the functions described in detail elsewhere herein. For example, one or more servers 962 may be configured to function as clearinghouse servers for reconciling actual coin-out and theoretical coin-out between multiple gaming establishments, e.g., for gaming establishments 905, 993, 995 and/or 997. One or more servers 962, storage devices 964 and/or host devices 960 of central system 963 may maintain player account information, including but not limited to persistence state information.

Some gaming networks provide features for gaming tables that are similar to those provided for gaming machines, including but not limited to bonusing, player loyalty/player tracking, the use of cashless instruments, etc. Some such gaming tables 953 may provide persistence games, e.g., as described elsewhere herein. Some configurations can provide automated, multi-player roulette, blackjack, baccarat, and other table games. The table games may be conducted by a dealer and/or by using some form of automation, which may include an automated roulette wheel, an electronic representation of a dealer, etc. In some such implementations, devices such as cameras 909, radio frequency identification devices 917 and 927, etc., may be used to identify and/or track patrons, playing cards, chips, etc. Some of gaming tables 953 may be configured for communication with individual player terminals (not shown), which may be configured to accept bets, present an electronic representation of a dealer, indicate game outcomes, etc.

Moreover, some such automated gaming tables 953 and/or associated player terminals may include, or may be configured for communication with, a device that includes a theoretical coin-out meter, a ticket reader, a card reader, a ticket printer, and/or other related features. Such features may provide the automated gaming tables 953 with persistence state information, update persistence state information according to wager gaming sessions at the automated gaming tables 953, calculate and/or store theoretical coin-out data for the automated gaming tables 953 and/or reconcile theoretical coin-out and actual coin-out data for the automated gaming tables 953. In some implementations, one such device may provide such functionality to a plurality of automated gaming tables 953 and/or associated player terminals.

Gaming establishment 905 also includes networked kiosks 977. Kiosks 977 may include card readers, ticket readers, printers, a user interface system, one or more displays, etc. Depending on the implementation, kiosks 977 may be used for various purposes, including but not limited to cashing out, prize redemption, redeeming points from a player loyalty program, redeeming "cashless" indicia such as bonus tickets, smart cards, etc.

According to some embodiments, kiosks 977 may be configured to provide, at least in part, some aspects of the invention. For example, kiosks 977 may be configured to receive cards, receive tickets and/or print tickets for gaming devices (such as mobile gaming devices 970, gaming tables, etc.) lacking one or more of such features. In such implementations, kiosks 977 may be configured to read persistence state information from, and/or write persistence state information to, a portable instrument such as a smart card, a ticket, a card having a magnetic strip, etc. The corresponding gaming devices are preferably configured for communication with such kiosks 977 and vice versa. Accordingly, some such kiosks 977 may include a wireless interface that is configured for communication with mobile gaming devices 970.

Moreover, kiosks 977 (or other devices) may be configured to implement, at least in part, a theoretical coin-out meter for another device that lacks a theoretical coin-out meter. In some embodiments, a kiosk 977 may be configured to reconcile theoretical and actual coin-out for a group of gaming machines 921, e.g., for a bank of gaming machines 921 or another such local group of gaming machines 921. In alternative embodiments, one of gaming machines 921 may be configured to reconcile theoretical and actual coin-out for a group of gaming machines 921.

In this example, each bank 910 has a corresponding switch 915. Each switch 915 is configured for communication with one or more devices in computer room 920 via main network device 925, which combines switching and routing functionality in this example. Although various communication protocols may be used, some preferred implementations use the Gaming Standards Association's G2S Message Protocol. Other implementations may use IGT's open, Ethernet-based SuperSAS® protocol. Still other protocols, including but not limited to Best of Breed ("BOB"), may be used to implement various aspects of the invention. Some systems may use a gaming-industry-specific transport layer called CASH™, which offers additional functionality and security.

Here, gaming establishment 905 also includes an RFID network, implemented in part by RFID switches 919 and multiple RFID readers 917. An RFID network may be used, for example, to track objects (such as mobile gaming devices 970, which include RFID tags 927 in this example), patrons, chips, player loyalty devices, etc., in the vicinity of gaming establishment 905.

Various alternative network topologies can be used to implement different aspects of the invention and/or to accommodate varying numbers of networked devices. For example, some gaming establishments may include cameras 909 for implementing advanced player tracking, player navigation or other functionality. Gaming establishments with large numbers of gaming machines 921 may require multiple instances of some network devices (e.g., of main network device 925, which combines switching and routing functionality in this example) and/or the inclusion of other network devices not shown in FIG. 9. Some embodiments may include one or more middleware servers disposed between kiosks 977, RFID switches 919 and/or bank switches 915 and one or more devices (e.g., a corresponding server, router or other network device) in computer room 920. Such middleware servers can provide various useful functions, including but not limited to the filtering and/or aggregation of data received from switches, from individual gaming machines and from other devices. Some implementations of the invention include load-balancing methods and devices for otherwise managing network traffic.

Figure 10:
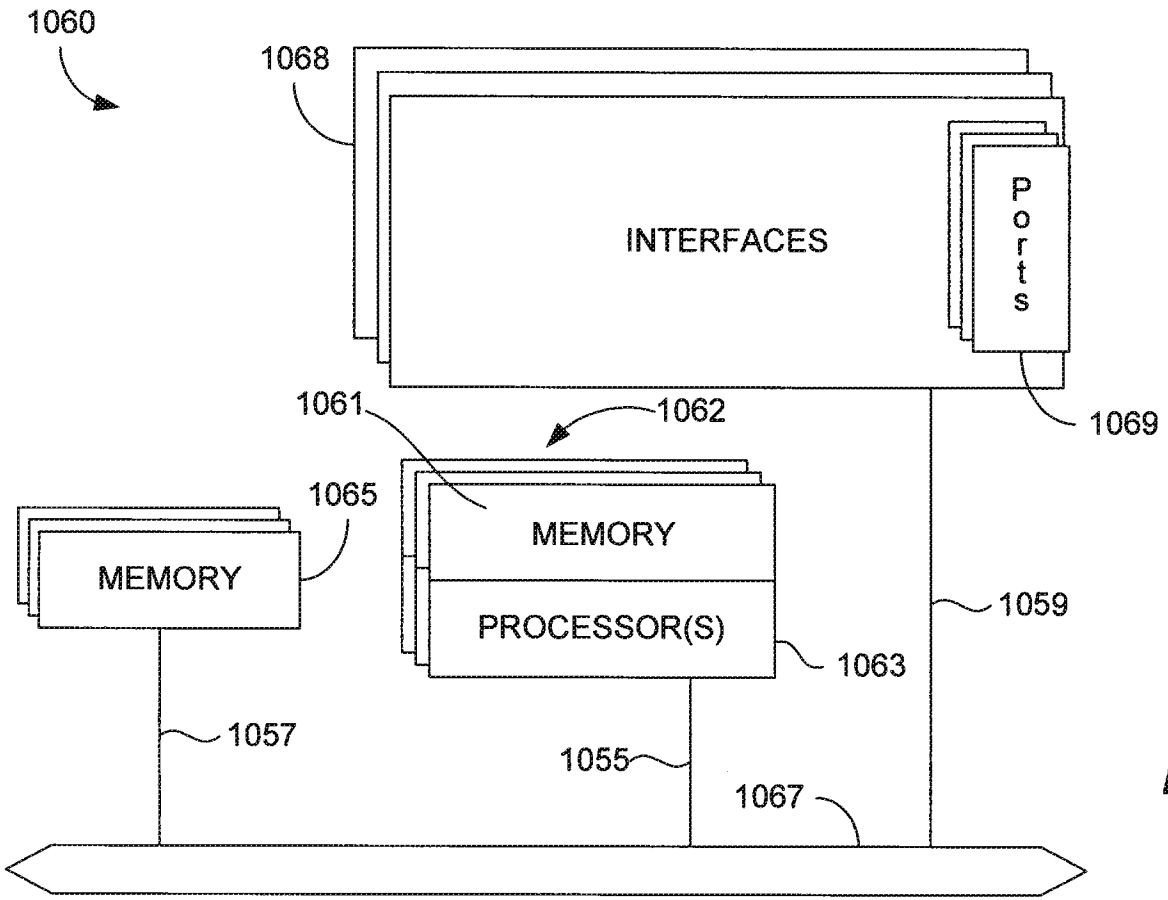
FIG. 10 depicts components of a network device, such as a server, that may be configured to perform some functions described herein.

FIG. 10 illustrates an example of a network device that may be configured for implementing some methods of the present invention. In this example, network device 1060 includes a master central processing unit (CPU) 1062, interfaces 1068, and a bus 1067 (e.g., a PCI bus). Generally, interfaces 1068 include ports 1069 appropriate for communication with the appropriate media. In some embodiments, one or more of interfaces 1068 includes at least one independent processor and, in some instances, volatile RAM. The independent processors may be, for example, ASICs or any other appropriate processors. According to some such embodiments, these independent processors perform at least some of the functions described herein. These independent processors and CPU 1062 may be regarded as components of the "logic system" of network device 1060.

Network device 1060 may be configured to provide various functionality described herein. For example, the logic system of network device 1060 may be configured to provide clearinghouse functionality within a gaming establishment and/or between gaming establishments for reconciling theoretical and actual coin-in. Alternatively, or additionally, network device 1060 may be configured to provide persistence state information to, and/or to receive persistence state information from, one or more gaming machines or other devices.

In some embodiments, one or more of the interfaces 1068 may control such communications-intensive tasks as encryption, decryption, compression, decompression, packetization, media control and management. By providing separate processors for the communications-intensive tasks, interfaces 1068 allow the CPU 1062 efficiently to perform other functions such as routing computations, server functionality, network diagnostics, security functions, etc. In some implementations, interfaces 1068 may be configured as individual "blades" of a blade server.

The interfaces 1068 may be provided as interface cards (sometimes referred to as "linecards"). Generally, interfaces 1068 control the sending and receiving of data packets over the network and sometimes support other peripherals used with the network device 1060. Among the interfaces that may be provided are FC interfaces, Ethernet interfaces, frame relay interfaces, cable interfaces, DSL interfaces, token ring interfaces, and the like. In addition, various very high-speed interfaces may be provided, such as fast Ethernet interfaces, Gigabit Ethernet interfaces, ATM interfaces, HSSI interfaces, POS interfaces, FDDI interfaces, ASI interfaces, DHEI interfaces and the like.

When acting under the control of appropriate software or firmware, in some implementations of the invention CPU 1062 may be responsible for implementing specific functions associated with the functions of a desired network device. According to some embodiments, CPU 1062 accomplishes all these functions under the control of software including an operating system and any appropriate applications software.

CPU 1062 may include one or more processors 1063 such as a processor from the Motorola family of microprocessors or the MIPS family of microprocessors. In an alternative embodiment, processor 1063 is specially designed hardware for controlling the operations of network device 1060. In a specific embodiment, a memory 1061 (such as non-volatile RAM and/or ROM) also forms part of CPU 1062. However, there are many different ways in which memory could be coupled to the system. Memory block 1061 may be used for a variety of purposes such as, for example, caching and/or storing data, programming instructions, etc.

Regardless of network device's configuration, it may employ one or more memories or memory modules (such as, for example, memory block 1065) configured to store data, program instructions for the general-purpose network operations and/or other information relating to the functionality of the techniques described herein. The program instructions may control the operation of an operating system and/or one or more applications, for example.

Because such information and program instructions may be employed to implement the systems/methods described herein, the present invention relates to machine-readable media that include program instructions, state information, etc. for performing various operations described herein. Examples of machine-readable media include, but are not limited to, magnetic media such as hard disks, floppy disks, and magnetic tape; optical media such as CD-ROM disks; magneto-optical media; and hardware devices that are specially configured to store and perform program instructions, such as read-only memory devices (ROM) and random access memory (RAM). The invention may also be embodied in a carrier wave traveling over an appropriate medium such as airwaves, optical lines, electric lines, etc. Examples of program instructions include both machine code, such as produced by a compiler, and files containing higher-level code that may be executed by the computer using an interpreter.

Although the system shown in FIG. 10 illustrates one specific network device of the present invention, it is by no means the only network device architecture on which the present invention can be implemented. For example, an architecture having a single processor that handles communications as well as routing computations, etc. is often used. Further, other types of interfaces and media could also be used with the network device. The communication path between interfaces may be bus based (as shown in FIG. 10) or switch fabric based (such as a cross-bar).

Although illustrative embodiments and applications of this invention are shown and described herein, many variations and modifications are possible which remain within the concept, scope, and spirit of the invention, and these variations should become clear after perusal of this application. For example, although many of the components and processes are described above in the singular for convenience, it will be appreciated that multiple components, repeated processes and/or more detailed processes can also be used to practice the techniques of the present invention. Moreover, the steps illustrated and described herein are not necessarily performed in the order indicated. Accordingly, the present embodiments are to be considered as illustrative and not restrictive, and the invention is not to be limited to the details given herein, but may be modified within the scope and equivalents of the appended claims.

We claim:

1. An electronic gaming system, comprising:

a server;

a plurality of electronic gaming machines, each of the gaming machines including a logic system that is configured for communication with the server, each gaming machine further including a non-transitory computer readable memory configured for communication with the logic system, the memory including instructions executable by the logic system for running on the gaming machine a persistence game having one or more recordable persistence states leading to a redeemable persistence award, each persistence state having a persistence value representing a portion of the persistence award, the persistence game interruptible at any one of the gaming machines and resumable at any other of the gaming machines at a recorded persistence state; and a theoretical coin-out meter configured for communication with the logic system for storing in the memory unawarded persistence values accumulated by the gaming machine from advancing the persistence game during game play among the one or more persistence states; wherein a program stored on a non-transitory machine-readable medium and executed by the server reconciles a persistence award redeemed at one of the gaming machines with unawarded persistence values accumulated at another one or more of the machines.

2. The electronic gaming system of claim 1, wherein, when any of the gaming machines redeems a persistence award, the logic system subtracts an expected value of the persistence award from a persistence value of a current persistence state.

3. The electronic gaming system of claim 1, wherein each of the gaming machines further includes:

a coin-out meter operated by the logic system for storing in the memory a value for accumulated coin-out disbursed by the gaming machine; and the theoretical coin-out meter calculating a value for theoretical coin-out as a sum of (i) the accumulated coin-out value and (ii) a difference between the persistence value of a current persistence state and the persistence value of a previous persistence state.

4. The electronic gaming system of claim 3, wherein, when any of the gaming machines redeems the persistence award, the theoretical coin-out meter of the redeeming gaming machine sets the value of the current persistence state to zero.

5. The electronic gaming system of claim 3, wherein each of the gaming machines further includes a coin-in meter operated by the logic system for storing in the memory a value for accumulated coin-in received by the gaming machine; and a return-to-player (RTP) calculator operated by the logic system executing a program in the memory, the calculator determining an RTP value as a ratio of the theoretical coin-out value to the accumulated coin-in value.

6. The electronic gaming system of claim 5, wherein for each of the gaming machines, the determined RTP value converges to a theoretical RTP value of the gaming machine over time, wherein the theoretical RTP value is based only on actual coin-in and actual coin-out.

7. The electronic gaming machine of claim 3, wherein a sum of the persistence values of the persistence states equals an average expected value of the persistence award.

8. The electronic gaming machine of claim 7, wherein the persistence values are incremented evenly.

9. The electronic gaming system of claim 1, wherein execution of the program is controlled by an entity having no ownership interest in the gaming machines.

10. In a network of gaming machines each including a logic system configured for communication with a server, and each having a non-transitory computer readable memory configured for communication with the logic system, the memory including instructions executable by the logic system for running on the gaming machine a persistence game having one or more recordable persistence states, the persistence states leading to a redeemable persistence award, a method for reconciling payback percentage attributable to one or more of the gaming machines with the persistence award redeemed on another of the gaming machines, the method comprising:

storing in the memory a persistence value for each of the persistence states, each persistence value representing a portion of the persistence award;

initiating play of the persistence game at any one of the gaming machines at a recorded persistence state;

calculating for each gaming machine played a value for theoretical coin-out as a function of the persistence value for each persistence state achieved after initiating play of the persistence game;

storing in the memory of the gaming machine played the value for theoretical coin-out;

recording each persistence state achieved after initiating play of the persistence game; and reimbursing a gaming machine redeeming the persistence award by an amount equal to the sum of theoretical coin-out values calculated for non-redeeming gaming machines that recorded persistence states during play of the persistence game.

11. The method of claim 10 further comprising, for any of the gaming machines redeeming a persistence award, subtracting an expected value of the persistence award from the persistence value of the current persistence state.

12. The method of claim 10, further comprising storing in the memory of at least one of the gaming machines a value for accumulated coin-out disbursed by the at least one gaming machine; and calculating the value for theoretical coin-out for the at least one gaming machine as a sum of (i) the accumulated coin-out value and (ii) a difference between the persistence value of a current persistence state and the persistence value of a previous persistence state.

13. The method of claim 12, further comprising, if the persistence criteria are satisfied, redeeming the persistence award, and setting the value of the current persistence state to zero.

14. The method of claim 12, further comprising storing in the memory of the at least one gaming machine a value for accumulated coin-in received by the at least one gaming machine; and calculating a return-to-player (RTP) value as a ratio of the theoretical coin-out value to the accumulated coin-in value.

15. The method of claim 14, wherein the calculated RTP value converges to a theoretical RTP value of the at least one gaming machine over time, wherein the theoretical RTP value is based only on actual coin-in and actual coin-out.

16. The method of claim 10, wherein a sum of the persistence values of the persistence states equals an average expected value of the persistence award.

17. The method of claim 16, wherein the persistence values are incremented evenly.

18. The method of claim 10, wherein the reimbursing step is performed by a clearinghouse having no ownership interest in the gaming machines.

19. The method of claim 10, wherein the persistence values associated with persistence states are centrally stored in a memory accessible by the server.

20. The method of claim 10, wherein the gaming machines are located within a single casino.

21. The method of claim 10, wherein the gaming machines are located within more than one casino.

22. The method of claim 10, wherein the gaming machines are located within a single jurisdiction.

23. The method of claim 10, wherein the gaming machines are located across more than one jurisdiction.

24. The method of claim 10, wherein the initiating process comprises accessing the recorded persistence state via the server.

25. The method of claim 10, wherein the initiating process comprises accessing the recorded persistence state via a player portable instrument readable by at least one of the gaming machines.

* * * * *